US012773078B2

(12) United States Patent
Keller et al.

(10) Patent No.: US 12,773,078 B2
(45) Date of Patent: Oct. 27, 2026

(54) FLOOR CLEANING APPARATUS

(71) Applicant: Diversey, Inc., Fort Mill, SC (US)

(72) Inventors: Thomas Keller, St. Gallen (CH); Mario Wetzlei, Flawil (CH)

(73) Assignee: Diversey, Inc., Fort Mill, SC (US)

( * ) Notice: Subject to any disclaimer, the term of this patent is extended or adjusted under 35 U.S.C. 154(b) by 447 days.

(21) Appl. No.: 18/553,247

(22) PCT Filed: Mar. 31, 2022

(86) PCT No.: PCT/EP2022/058609
§ 371 (c)(1),
(2) Date: Sep. 29, 2023

(87) PCT Pub. No.: WO2022/207811
PCT Pub. Date: Oct. 6, 2022

(65) Prior Publication Data

US 2024/0206689 A1 Jun. 27, 2024

(30) Foreign Application Priority Data

Mar. 31, 2021 (IT) ..... 102021000008129

(51) Int. Cl.
*A47L 9/00* (2006.01)
*A47L 7/00* (2006.01)
*A47L 11/40* (2006.01)

(52) U.S. Cl.
CPC ..... *A47L 9/0081* (2013.01); *A47L 7/0023* (2013.01); *A47L 11/4016* (2013.01); *A47L 11/4097* (2013.01)

(58) Field of Classification Search
CPC .. A47L 9/0081; A47L 7/0023; A47L 11/4016; A47L 11/4097; A47L 9/22
See application file for complete search history.

(56) References Cited

U.S. PATENT DOCUMENTS

2006/0096058 A1* 5/2006 Oh ..... A47L 9/22 15/326
2020/0178740 A1* 6/2020 Keller ..... A47L 9/22
(Continued)

FOREIGN PATENT DOCUMENTS

CN 106175584 A * 12/2016 ..... A47L 9/0081
CN 106235959 A * 12/2016 ..... A47L 9/2868
(Continued)

OTHER PUBLICATIONS

WO 2015032151 A1—English Machine Translation (Year: 2015).*
ISA/EP, International Search Report and Written Opinion issued in int. appl. No. PCT/EP2022/058609, mailed Aug. 3, 2022.

*Primary Examiner* — Marc Carlson
(74) *Attorney, Agent, or Firm* — Ingrassia Fisher & Lorenz LLP

(57) ABSTRACT

A floor cleaning apparatus (1) is provided including a cleaning assembly (500), a suction unit (10), an inlet channeling unit (20), and an outlet channeling unit (30). The suction unit (10) has a motor (11) and an impeller (12). The inlet channeling unit (20) is in fluid communication with at least one portion of the cleaning assembly (500). The outlet channeling unit (30) connects the suction unit (10) to an exhaust aperture (40). The outlet channeling unit (30) includes a first expansion chamber (31) and at least one intercepting wall (100). The first expansion chamber (31) faces the outlet side of the impeller (12). The at least one intercepting wall (100) comprises a plurality of through holes (101). The intercepting wall (100) operates inside the first expansion chamber (31).

9 Claims, 18 Drawing Sheets

(56) References Cited

U.S. PATENT DOCUMENTS

| | | | | |
|---|---|---|---|---|
| 2023/0348169 | A1* | 11/2023 | Conrad | A01N 59/20 |
| 2024/0164612 | A1* | 5/2024 | Keller | A47L 9/0081 |

FOREIGN PATENT DOCUMENTS

| | | | | | |
|---|---|---|---|---|---|
| CN | 106264318 | A | * | 1/2017 | A47L 9/00 |
| CN | 107095616 | A | * | 8/2017 | A47L 9/0081 |
| CN | 109106275 | A | * | 1/2019 | A47L 9/0081 |
| CN | 109106277 | A | * | 1/2019 | A47L 9/0081 |
| CN | 110575095 | A | * | 12/2019 | A47L 9/0081 |
| CN | 110664307 | A | * | 1/2020 | A47L 9/28 |
| CN | 111096708 | A | * | 5/2020 | A47L 9/0081 |
| CN | 111835130 | A | * | 10/2020 | H02K 5/24 |
| CN | 112704430 | A | * | 4/2021 | F04D 29/4226 |
| CN | 114607645 | A | * | 6/2022 | G10K 11/172 |
| EP | 3238592 | A1 | * | 11/2017 | A47L 9/22 |
| EP | 3685723 | A1 | * | 7/2020 | A47L 9/0081 |
| FR | 3120296 | A1 | * | 9/2022 | A47L 9/0081 |
| JP | S5630857 | U | | 3/1981 | |
| JP | S5925720 | A | | 2/1984 | |
| WO | WO-2015032151 | A1 | * | 3/2015 | A47L 9/122 |
| WO | WO-2016058434 | A1 | * | 4/2016 | A47L 9/00 |
| WO | WO-2017092832 | A1 | * | 6/2017 | A47L 9/22 |
| WO | WO-2018152928 | A1 | * | 8/2018 | A47L 9/322 |

* cited by examiner

FIG.3
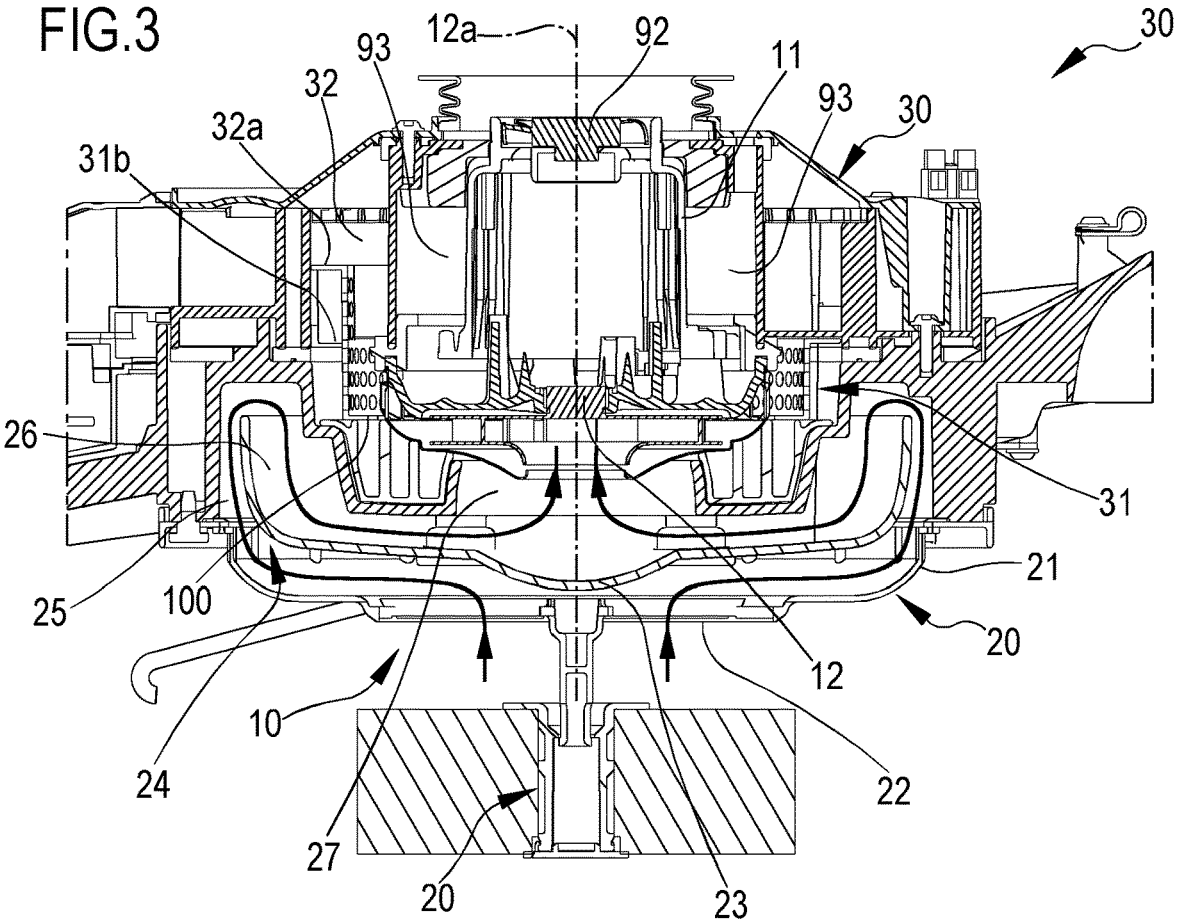
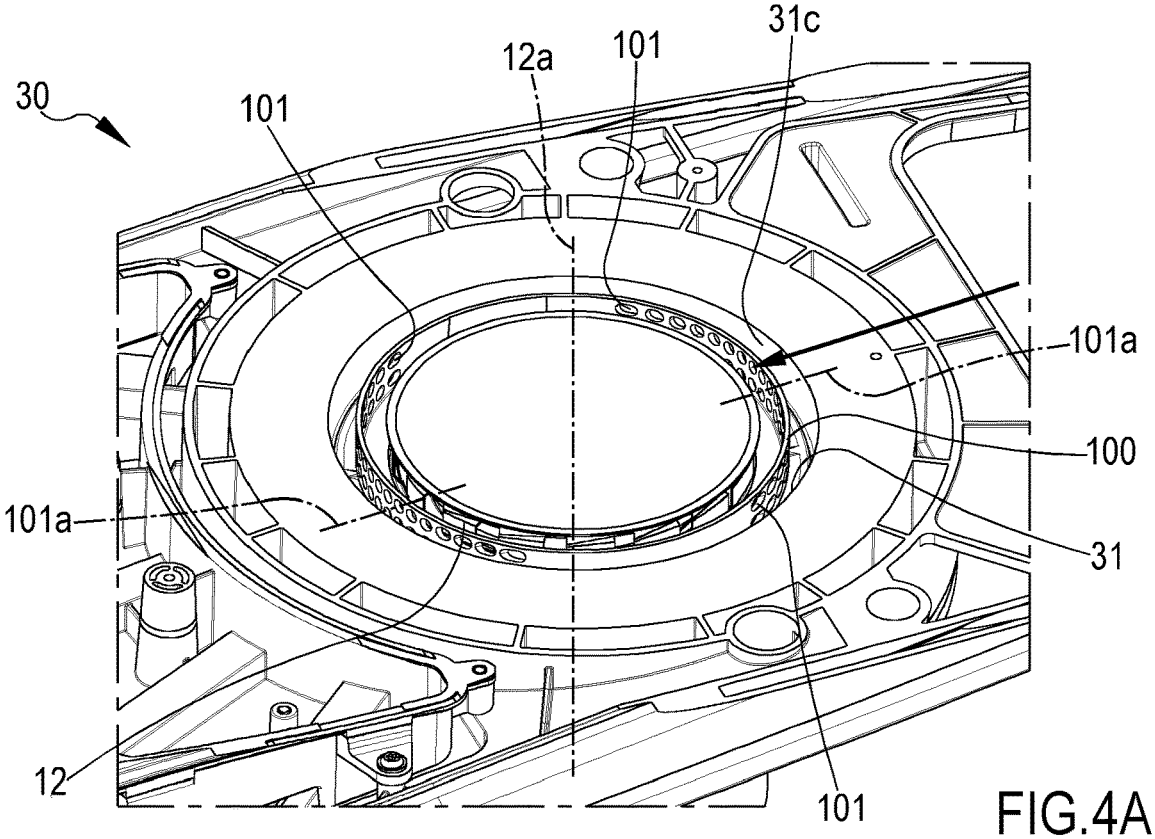
FIG.4A

FIG.19
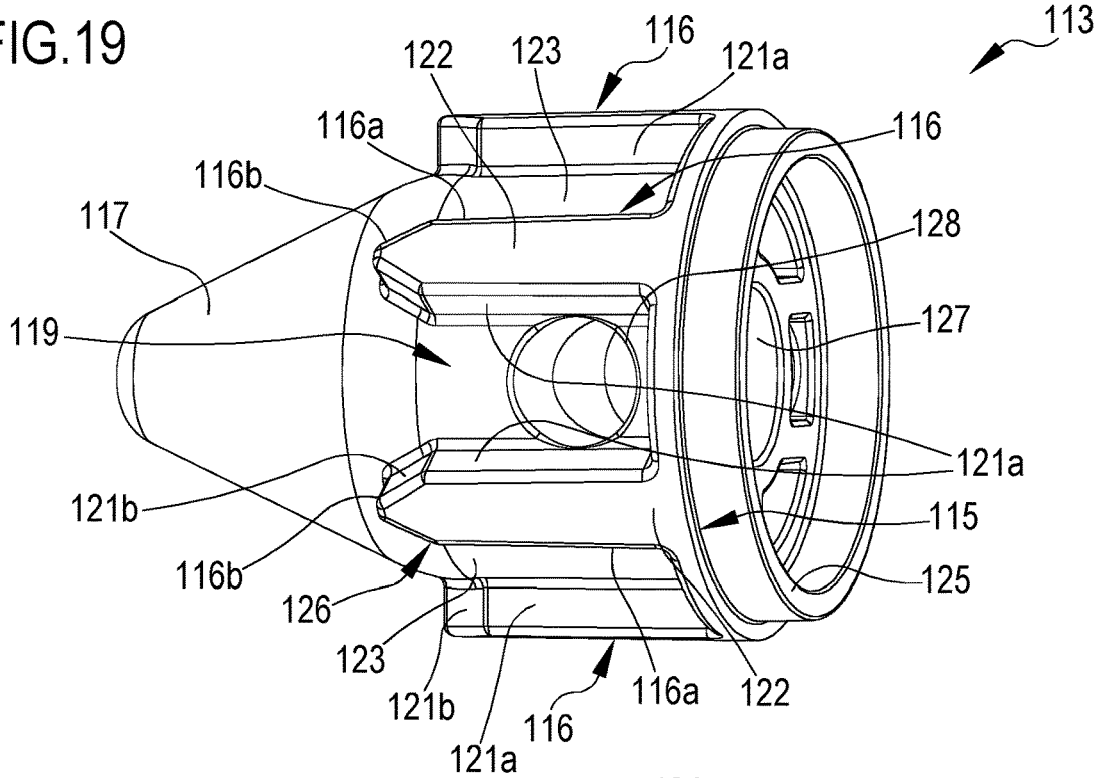
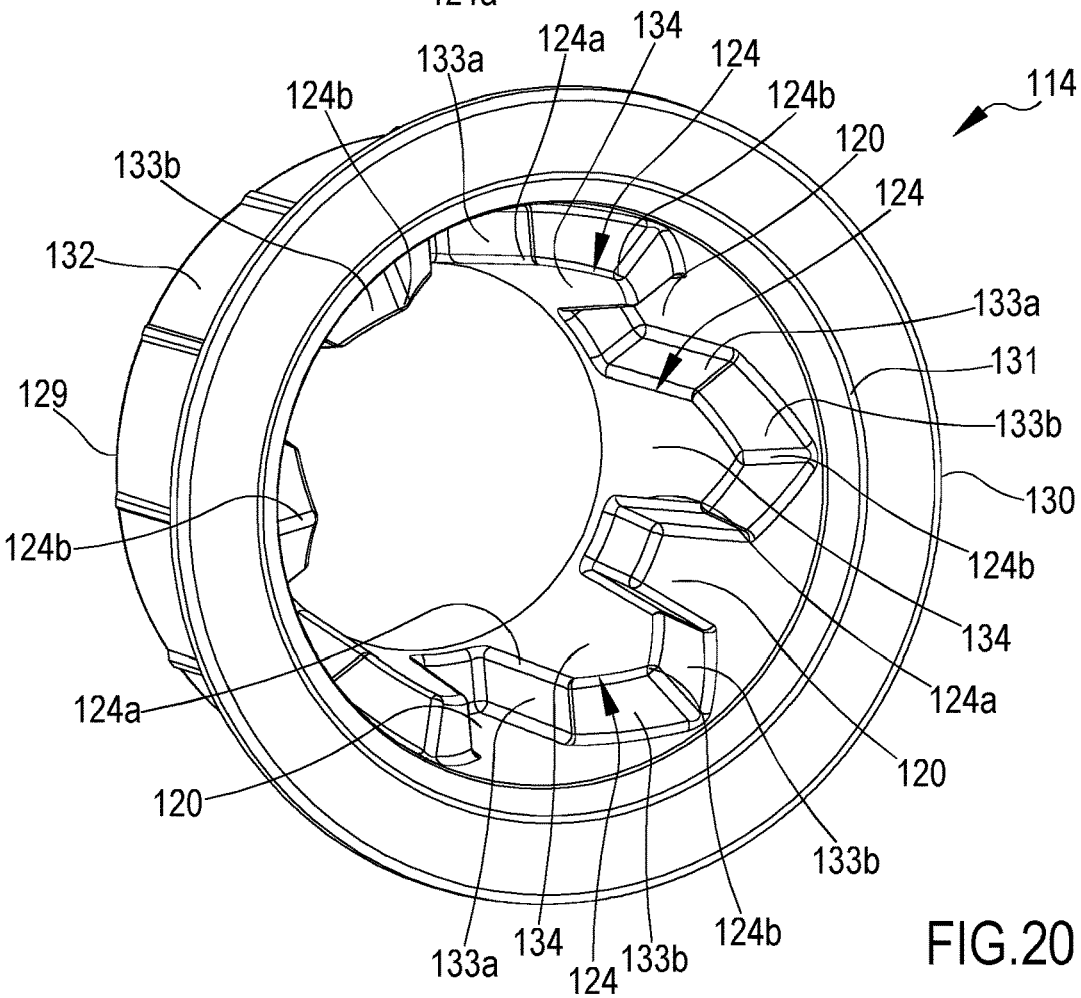
FIG.20

FLOOR CLEANING APPARATUS

CROSS-REFERENCE TO RELATED APPLICATION

This application is a U.S. National-Stage entry under 35 U.S.C. § 371 based on International Application No. PCT/EP2022/058609, filed Mar. 31, 2022, which was published under PCT Article 21(2) and which claims priority to Italian Patent Application No. 102021000008129, filed Mar. 31, 2021, which are all hereby incorporated in their entirety by reference.

TECHNICAL FIELD

The present invention refers to the field of apparatuses for cleaning floors or flat surfaces. The floor cleaning apparatus object of the invention may include one or more suction devices and may be an actual vacuum cleaner or an apparatus having one or more suction devices and/or a cleaning or washing unit of the surface to be treated, for example comprising one or more components such as a water or a cleaning solution dispenser, one or more brushes, one or more elements configured for cleaning the floor surface or other active elements for cleaning the floor surface.

BACKGROUND OF THE INVENTION

As it is known, some floor cleaning apparatuses include suction devices for removing debris and/or liquids from the floor surface.

The suction force necessary for sucking the material to be removed is generated by a motor and by a group of one or more impellers configured such that the debris and/or liquids are sucked through an air inlet and conveyed towards a collection unit inside the apparatus.

In the conventional floor cleaning apparatuses, various factors contribute to generate noise, i.e.:

- the motor assembly and the blade impeller, which operate at relatively high angular speeds and may be very noisy,
- the vibrations induced on the chassis and the various supporting walls of the apparatus,
- air flows through inlet and outlet conduits.

On the other hand, reducing the rotational speed of the impeller or reducing the air velocity in the conduits may have deleterious effects on the operation and performance of the action exerted by the suction device(s).

Furthermore, in the known devices of the type using cleaning discs in contact with the floor, there is an imperfect cleaning action in the central area of the machine.

On the other hand, floor cleaning machines equipped with cleaning rollers are also characterized by an inadequate regulation of the load acting on the rollers, leading to their rapid wear and the need for frequent replacement, which is often made difficult by the type of coupling between the cleaning roller and the machine.

BRIEF SUMMARY

A floor cleaning apparatus (1) includes a cleaning assembly (500), a suction unit (10), an inlet channeling unit (20), and an outlet channeling unit (30). The suction unit (10) is provided with a motor (11) and an impeller (12) coupled with the motor (11). The inlet channeling unit (20) is operative at an inlet side of the suction unit (10). The inlet channeling unit (20) is in fluid communication with at least one portion of the cleaning assembly (500). The outlet channeling unit (30) connects an outlet side of the suction unit (10) to at least one exhaust aperture (40) of the floor cleaning apparatus (1). The outlet channeling unit (30) includes a first expansion chamber (31) and at least one intercepting wall (100). The first expansion chamber (31) faces the outlet side of the impeller (12) and has an outlet port (31*a*) in fluid communication with the exhaust aperture (40). The at least one intercepting wall (100) comprises a plurality of through holes (101). The intercepting wall (100) operates inside the first expansion chamber (31) and is positioned to intercept air flow moving from the impeller outlet side to the outlet port (31*a*) of the first expansion chamber (31).

BRIEF DESCRIPTION OF DRAWINGS

Aspects of the present invention will appear from the following detailed description, which is provided by way of non-limiting example, and from the following drawings, which are as well provided by way of non-limiting example, wherein:

FIG. 3 shows a part of FIG. 2 in further enlarged view;

FIG. 4A is an interrupted perspective view of a part of the air outlet channeling unit related to a first expansion chamber of the air coming from the suction unit;

FIG. 19 shows a perspective view of a male component of a connector intended to be interposed between a support framework of the cleaning unit of FIG. 16 and one end of a cleaner roller, for rotatably engaging the cleaner roller itself to the support framework, according to further aspects of the invention;

FIG. 20 shows a front perspective view of the male component of FIG. 19;

DETAILED DESCRIPTION

Figure 1:
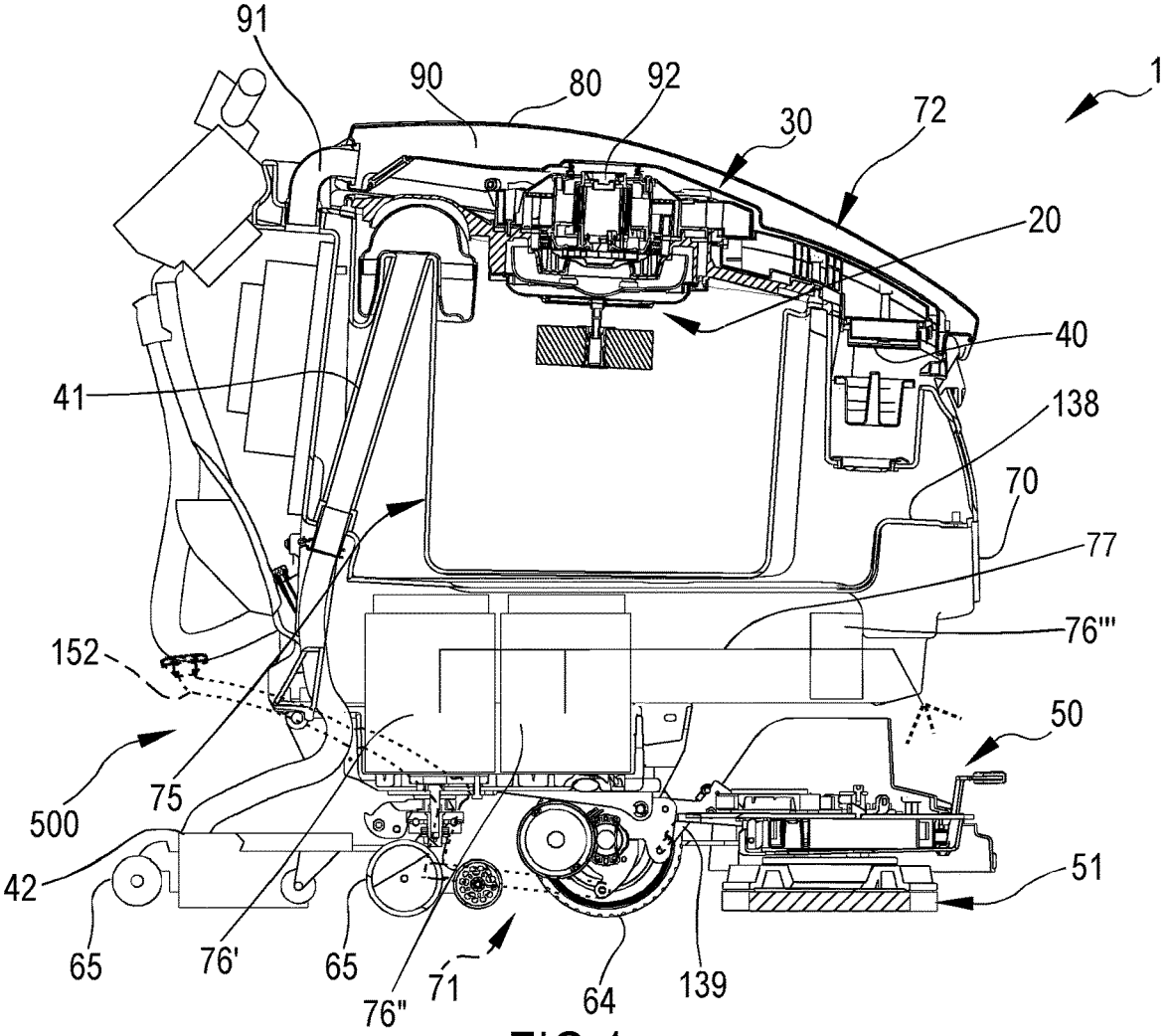
FIG. 1 shows a longitudinal section of a floor cleaning apparatus according to aspects of the invention.

The following detailed description is merely exemplary in nature and is not intended to limit the disclosure or the application and uses of the subject matter as described herein. Furthermore, there is no intention to be bound by any theory presented in the preceding background or the following detailed description.

In view of the foregoing, it is an object of certain aspects of the present disclosure to provide a floor cleaning apparatus capable of offering an effective reduction in operating noise without adversely affecting the operating performance of the apparatus itself.

An auxiliary object of certain aspects of the present disclosure is to achieve noise reduction in a floor cleaning apparatus equipped, in addition to a suction device, also with other organs useful for cleaning the floor for example using water or other cleaning solutions.

In detail, it is an object of certain aspects of the present disclosure to provide a floor cleaning apparatus that is capable of efficiently reducing noise without compromising the ability of the suction device to operate efficiently and without adversely affecting the operational performance of the floor cleaning unit.

Furthermore, it is another object of certain aspects of the present disclosure to offer an apparatus with a spent air channeling able to minimize noise generated by vibrations and to acoustically isolate the motor-impeller assembly in an efficient manner.

It is also an object of certain aspects of the present disclosure to provide an apparatus capable of adequately supporting the cleaning unit so as to ensure an efficient cleaning action and at the same time reduce wear on the cleaning organs.

An additional object of certain aspects of the present disclosure is to provide an apparatus in which the cleaning unit is easily constrained to the chassis of the apparatus itself, also allowing an easy movement from an operating position to a resting position of the cleaning unit.

It is also an object of certain aspects of the present disclosure to provide an apparatus having cleaning discs which are capable of promoting a uniform floor cleaning.

Furthermore, it is an object of certain aspects of the present disclosure to provide a support system for the cleaning discs having a reliable and simple structure.

In addition, it is an object of certain aspects of the present disclosure to offer a floor cleaning apparatus with a cleaning disc unit, optionally with offset cleaning discs, capable of facilitating the movement of the apparatus along the work path.

An object of certain aspects of the present disclosure is also to provide cleaner rollers with an innovative connection system to the cleaning unit of a floor cleaning apparatus.

An additional object of certain aspects of the present disclosure is to offer a floor cleaning apparatus with a cleaning unit equipped with one or more cleaner rollers having said connection system capable of facilitating the assembly and disassembly of the cleaner roller/s themselves.

Another purpose of certain aspects of the present disclosure is to provide a connection system that is extremely reliable in transmitting torque to each cleaner roller.

Finally, it is an object of certain aspects of the present disclosure to provide a rollers-cleaning unit connection system which is able to automatically guide the operator in the assembly phases of the cleaner roller even in case of cleaning units of considerable width where it is difficult to visually access the coupling area between the end of the roller and the cleaning unit.

One or more of the above-mentioned objects are substantially achieved by a floor cleaning apparatus according to any one of the enclosed claims.

Further aspects of the present disclosure are described below.

Aspects of the present disclosure are described below.

In a 1st aspect a floor cleaning apparatus (1) is provided comprising:

- a cleaning assembly (500);
- a suction unit (10) provided with a motor (11) and an impeller (12) coupled with the motor (11);
- an inlet channeling unit (20), operative at an inlet side of the suction unit (10), wherein the inlet channeling unit (20) is in fluid communication with at least one portion of the cleaning assembly (500);
- an outlet channeling unit (30), connecting an outlet side of the suction unit (10) to at least one exhaust aperture (40) of the floor cleaning apparatus (1),
- wherein the outlet channeling unit (30) includes a first expansion chamber (31).

In a 2nd aspect according to the preceding aspect, the outlet channeling unit (30) includes:

- a second expansion chamber (32) positioned downstream the first expansion chamber (31), a first compression channel or orifice (33) placing in fluid communication the first expansion chamber (31) with the second expansion chamber (32), a third expansion chamber (34) positioned downstream the second expansion chamber (32), and a second compression channel or orifice (35) placing in fluid communication the second expansion chamber (32) with the third expansion chamber (34).

In a 3rd aspect according to any one of the preceding aspects, the first expansion chamber (31) extends about a periphery of the impeller (12) defining an annular flow volume entirely surrounding the impeller (12).

In a further aspect according to the preceding aspect, the annular flow volume of the first expansion chamber (31) has a constant radial width.

In a 4th aspect according to the two preceding aspects, the annular flow volume of the first expansion chamber (31) has a transversal air flow cross sectional area, measured perpendicular to an axis of rotation (12*a*) of the impeller (12) in the form of an annulus, said transversal air flow cross sectional area having a prefixed maximum area.

In a 5th aspect according to the preceding aspect, the first compression channel or orifice (33) has a transversal air flow cross sectional area, measured perpendicular to the axis of rotation (12*a*) of the impeller (12), having a prefixed minimum area smaller than, optionally at least 1.5 times smaller than, more optionally at least 5 times smaller than, even more optionally at least 10 times smaller than, said maximum transversal air flow cross sectional area of the annular flow volume of the first expansion chamber (31).

In a 6th aspect according to any one of the preceding aspects, the first expansion chamber (31) is concentrically positioned around the impeller (12), and/or wherein the annular flow volume of the first expansion chamber (31) has a constant radial width.

In a 7th aspect according to any one of the preceding aspects from the 2nd to the 6th, the first compression channel or orifice (33) extends in a non-radial direction, optionally parallel to the axis of rotation (12*a*) of the impeller (12), from an outlet (31*b*) of the first expansion chamber (31) towards an inlet (32*a*) of the second expansion chamber (32).

In a 8th aspect according to any one of the preceding aspects from the 2nd to the 7th, the second expansion chamber (32) is positioned above, and substantially overlapping to, the first expansion chamber (31).

In a 9th aspect according to any one of the preceding aspects from the 4th to the 8th, the second expansion chamber (32) has a substantially annular flow volume, concentric with said axis of rotation (12*a*) of the impeller (12), to collect air coming from a downstream end (33*b*) of the first compression channel or orifice (33) and convey collected air towards an outlet port (32*b*) of the second expansion chamber (32), positioned opposite to the downstream end (33*b*) of the first compression channel or orifice (33).

In a 10th aspect according to the preceding aspect, the annular flow volume of the second expansion chamber (32) includes two semi-annular branches (36) symmetrically opposite with respect to an ideal plane of symmetry (la) containing the axis of rotation (12*a*) of the impeller (12).

In a 11th aspect according to the preceding aspect, each semi-annular branch (36) connecting the/a downstream end (33*b*) of the first compression channel or orifice (33) to the outlet port (32*b*) of the second expansion chamber (32).

In a 12th aspect according to the 10th or 11th aspect, the first compression channel or orifice (33) has a transversal air flow cross sectional area, measured perpendicular to the axis of rotation (12*a*) of the impeller (12), having a prefixed minimum area smaller than, optionally at least 1.5 times smaller than a sum of the maximum transversal air flow cross sectional areas, measured on a first ideal plane radially crossing said semi-annular branches (36) and containing the axis of rotation (12*a*) of the impeller (12), of the two semi-annular branches of the second expansion chamber (32).

In a 13th aspect according to the preceding aspect, the first compression channel or orifice (33) has a transversal air flow cross sectional area, measured perpendicular to the axis of rotation (12*a*) of the impeller (12), having a prefixed minimum area that is between 5 and 10 times or even more than 10 times smaller than a sum of the maximum transversal air flow cross sectional areas, measured on a first ideal plane radially crossing said semi-annular branches (36) and containing the axis of rotation (12*a*) of the impeller (12), of the two semi-annular branches of the second expansion chamber (32).

In a 14th aspect according to any of the aspects from the 2nd to the 13th, the outlet channeling unit (30) includes two peripheral channels (37), each of which surrounding a respective portion of the second expansion chamber (32).

In a 15th aspect according to the preceding aspect, each peripheral channel (37) has an intake end (37*a*), at the outlet port (32*b*) of the second expansion chamber (32), and an outlet end (37*b*), opposite to the intake end (37*a*), connected to an upstream end (35*a*) of the second compression channel or orifice (35).

In a 16th aspect according to the 14th or the 15th aspect, the two peripheral channels (37) form respective semi-annular fluid volumes, each being adjacent to a respective semi-annular branch (36) of the second expansion chamber (32).

In a 17th aspect according to any one of the preceding aspects from the 14th to the 16th, the two peripheral channels (37) have outlet ends (37*b*) which join together at the upstream end (35*a*) of the second compression channel or orifice (35).

In a 18th aspect according to the 16th or the 17th aspect, the semi-annular fluid volume of each peripheral channel (37) has transversal air flow cross sectional area, measured on an/the first ideal plane radially crossing the semi-annular branches (36) and comprising the axis of rotation (12*a*) of the impeller (12), of a maximum area substantially equal to, or differing by no more than 20%, with respect to the maximum transversal air flow cross sectional area of the respective adjacent semi-annular branch (36) of the second expansion chamber (32).

In a 19th aspect according to any one of the preceding aspects from the 11th to the 18th, the second compression channel or orifice (35) has a transversal air flow cross sectional area, measured perpendicular to a further ideal plane radially crossing the second compression channel or orifice (35) and containing the axis of rotation (12*a*), having a prefixed minimum area smaller than, optionally at least 1.5 times smaller than, more optionally at least 2 times smaller than, even more optionally at least 5 times smaller than, the sum of the maximum transversal air flow cross sectional areas, measured on an/the ideal plane radially crossing said semi-annular branches (36) and containing the axis of rotation (12*a*) of the impeller (12), of the two semi-annular branches of the second expansion chamber (32). For example, the ratio between the mentioned areas of this aspect may be between 5 and 10.

In a 20th aspect according to any one of the preceding aspects from the 2nd to the 19th, the first compression channel or orifice (33) and the second compression channel or orifice (35) are positioned on the same side of the outlet channeling unit (30), with the second compression channel or orifice (35) being positioned at least in part, optionally entirely, above the first compression channel or orifice (33).

In a 21 st aspect according to any one of the preceding aspects from the 4th to the 20th, the second compression channel or orifice (35) extends, at least in part, radially away from the axis of rotation (12*a*) of the impeller and has a downstream end (35*b*) that joins an inlet (34*a*) of the third expansion chamber (34).

In a 22nd aspect according to any one of the preceding aspects from the 4th to the 21st, the third expansion chamber (34) extends radially away from the axis of rotation (12*a*) of the impeller (12).

In a 22nd bis aspect according to any one of the preceding aspects from the 4th to 21st, the third expansion chamber (34) extends radially opposite to the outlet port (32*b*) of said second expansion chamber (32).

In a 23rd aspect according to any one of the preceding aspects from the 19th to the 22nd bis, the third expansion chamber (34) has a transversal air flow cross sectional area measured perpendicular to said further ideal plane, having a prefixed maximum area greater than, optionally at least 1.5 times greater than, more optionally at least 5 times greater than, even more optionally at least 10 times greater than, the minimum area of the transversal air flow cross sectional area of the second compression channel or orifice (35) measured perpendicular to the same further ideal plane.

In a 24th aspect according to any one of the preceding aspects from the 2nd to the 23rd, the outlet channeling unit (30) includes a transition channel (38) extending between the third expansion chamber (34) and a fourth expansion chamber (39), the latter terminating into the exhaust aperture (40) of the floor cleaning apparatus (1).

In a 25th aspect according to the preceding aspect, the fourth expansion chamber (39) has a transversal air flow cross sectional area, measured perpendicular to said further ideal plane, having a prefixed maximum area greater than, optionally at least 1.5 times greater than, more optionally at least 5 times greater than, even more optionally at least 10 times greater than, the minimum area of the transversal air flow cross sectional area of the transition channel (38) measured parallel to the same further ideal plane.

In a 26th aspect according to the 24th or the 25th aspect, the transition channel (38) defines an air flow path that has a zig-zag conformation, so an air flow from the third expansion chamber (34) to the fourth expansion chamber (39) changes direction at least twice before reaching the exhaust aperture.

In a 27th aspect according to any one of the preceding aspects from the 24th to the 25th, the transition channel (38) includes at least one deflector (38*a*), optionally at least two deflectors (38*a*, 38*b*), positioned transversely to the further ideal plane. In a sub-aspect according to the 27th aspect, there is no straight line passing through the exhaust aperture which passes through the outlet of the second compression channel or orifice without impacting on at least said one deflector, optionally on both said deflectors.

In a 28th aspect according to any one of the preceding aspects from the 9th to the 27th, there is no straight line passing through the outlet port (32*b*) of the second expansion chamber (32) and crossing the first compression channel or orifice (33), without impacting on at least one other component of the outlet channeling unit (30).

In a 29th aspect according to any one of the preceding aspects from the 9th to the 28th, there is no straight line passing through the outlet port (32*b*) of the second expansion chamber (32) and crossing the second compression channel or orifice (35), without impacting on at least one other component of the outlet channeling unit (30).

In a 30th aspect according to any one of the preceding aspects from the 14th to the 29th, each of the two peripheral channels (37) is separated from the respective adjacent semi-annular branch (36) by a hollow separation septum (36').

In a 31st aspect according to the preceding aspect, the hollow separation septum (36') is radially delimited by a radially internal wall and by a radially external wall which are radially distanced from one another to define one or more internal insulation cavities (36").

In a 32nd aspect according to the preceding aspect, each of said internal insulation cavities (36") of the hollow separation septum is filled with air or with sound-absorbing material.

In a 33rd aspect according to the 31st or the 32nd aspect, the/each internal insulation cavity (36") of the hollow separation septum (36') is gas-tightly insulated from an environment external to the hollow separation septum.

In a 34th aspect according to any one of the preceding aspects from the 27th to the 33rd, the at least one deflector (38*a*) is a hollow body including one or more internal insulation cavities (38'), optionally each of the at least two deflectors (38*a*, 38*b*) is a hollow body including one or more internal insulation cavities.

In a 35th aspect according to the preceding aspect, each of said internal insulation cavities of each deflector is filled with air or with sound-absorbing material.

In a 36th aspect according to the 34th or the 35th aspect, the/each internal insulation cavity (38') of each deflector (38*a*, 38*b*) is gas-tightly insulated from an environment external to the deflector itself.

In a 37th aspect according to any one of the preceding aspects, the apparatus includes at least one suction pipe (41), wherein the inlet channeling unit (20) is in fluid communication with said at least one portion of the cleaning assembly (500) via the suction pipe (41).

In a 38th aspect according to any one of the preceding aspects, the apparatus includes at least one spent liquid receptacle (75), the inlet channeling unit (20) being positioned above the spent liquid receptacle (75) and the suction pipe (41) connecting said at least one portion of the cleaning assembly (500) with the at least one spent liquid receptacle (75).

In a 39th aspect according to the preceding aspect, the inlet channeling unit (20) is in fluid communication with said suction pipe (41) and with the spent liquid receptacle (75).

In a 40th aspect according to any one of the preceding aspects, to the apparatus no alveolar material is applied.

In a 41 st aspect according to any one of the preceding aspects from the 24th to the 40th, the apparatus does not include foam material, to walls delimiting the first expansion chamber (31) or to walls delimiting the second expansion chamber (32) or to walls delimiting the third expansion chamber (34) or to walls delimiting the fourth expansion chamber (39).

In a 42nd aspect according to any one of the preceding aspects, the entire outlet channeling unit (30) does not include any alveolar material, optionally it does not include any foam material, contacting an air flow crossing the outlet channeling unit and/or wherein the entire inlet channeling unit (20) does not include any alveolar material, optionally it does not include any foam material, contacting an air flow crossing the inlet channeling unit.

In a 43rd aspect according to any one of the preceding aspects, the apparatus includes a housing (70) containing the at least one spent liquid receptacle (75).

In a 44th aspect according to any one of the preceding aspects, the cleaning assembly (500) is associated to an inferior portion (71) of the housing (70).

In a 45th aspect according to any one of the preceding aspects, the suction unit (10), the inlet channeling unit (20) and the outlet channeling unit (30) are associated to a top portion (72) of the housing (70).

In a 46th aspect according to any one of the preceding aspects from the 43rd to the 45th, the apparatus includes a cover structure (80), which is engaged above the housing (70), optionally removably engaged above the housing (70), and containing the suction unit (10), the inlet channeling unit (20) and the outlet channeling unit (30).

In a 47th aspect according to any one of the preceding aspects, the apparatus includes a motor cooling circuit (90) including: a fresh air inlet conduit (91), a fan (92) operative on a side of the motor (11) opposite to that of the impeller (12) and positioned to receive air coming from the fresh air inlet conduit (91), a spent air discharge path (93) passing at least around a portion of a body of the motor (11).

In a 48th aspect according to the 46th or the 47th aspect, the motor cooling circuit (90) is contained in the cover structure (80) and is kept separate from the inlet channeling unit (20), the outlet channeling unit (30) and the impeller (12).

In a 49th aspect according to any one of the preceding aspects from the 46th to the 48th, there is no fluid communication inside the cover structure (80) between the motor cooling circuit (90) on the one side, and the inlet channeling unit (20), the outlet channeling unit (30) and the impeller (12) on the other side.

In a 50th aspect according to any one of the preceding aspects, the first expansion chamber (31) faces the outlet side of the impeller (12) and has an outlet port (31*a*) in fluid communication with the exhaust aperture (40).

In a 51st aspect according to the preceding aspect, the outlet channeling unit (30) includes at least an intercepting wall (100) comprising a plurality of through holes (101). In a sub-aspect according to the 51st aspect, the intercepting wall (100) operates inside the first expansion chamber (31) and is positioned to intercept the air flow moving from the impeller outlet side to the outlet port (31*a*) of the first expansion chamber (31).

In a 52nd aspect according to the three preceding aspects, the first expansion chamber (31) extends about a periphery of the impeller (12) defining an annular flow volume entirely surrounding the impeller (12). In a sub-aspect according to the 53rd aspect, the intercepting wall (100) has annular shape and is fitted in the annular flow volume of the first expansion chamber (31).

In a 53rd aspect according to any one of the preceding aspects from the 50th to the 52nd, the first expansion chamber (31) radially extends between the outlet side of the impeller (12) and an outer peripheral wall (31*c*) surrounding the impeller (12) and positioned at a radial distance from the outlet side of the impeller (12).

In a 54th aspect according to the preceding aspect, the at least one intercepting wall (100) is positioned radially between the outlet side of the impeller (12) and the outer peripheral wall (31*c*) of the first expansion chamber (31).

In a 55th aspect according to any one of the preceding aspects from the 51 st to the 54th, the first expansion chamber (31) and/or the intercepting wall (100) is/are concentrically positioned with respect to the impeller (12) and extend all around the impeller periphery.

In a 56th aspect according to any one of the preceding aspects from the 51st to the 55th, the through holes (101) of the intercepting wall (100) have axial symmetry.

In a 57th aspect according to any one of the preceding aspects from the 51st to the 56th, the through holes (101) of the intercepting wall (100) have a cylindrical conformation.

In a 58th aspect according to any one of the preceding aspects from the 51st to the 57th, each one of the holes of said plurality of through holes (101) has an area of fluid passage measured perpendicular to the respective axis of symmetry (101*a*), comprised between 3 mm2 and 180 $mm^2$.

In a 59th aspect according to any one of the preceding aspects from the 51st to the 58th, the through holes (101) have respective axes of symmetry (101*a*) parallel to each other.

In a 60th aspect according to any one of the preceding aspects from the 51 st to the 58th, the through holes (101) have respective axes of symmetry (101*a*) converging towards a common axis, optionally converging towards an impeller axis of symmetry (12*a*).

In a 61st aspect according to any one of the preceding aspects from the 51st to the 60th, each one of the through holes (101) has transversal cross section, taken perpendicular to the respective axes of symmetry (101*a*), of circular type.

In a 62nd aspect according to any one of the preceding aspects from the 51st to the 61st, each one of the through holes (101) has cross section, taken perpendicular to the respective axes of symmetry (101*a*), which has a diameter comprised between 2 mm and 15 mm.

In a 63rd aspect according to any one of the preceding aspects from the 51st to the 62nd, the through holes are distributed, optionally homogeneously distributed, on the intercepting wall and positioned all around the impeller periphery.

In a 64th aspect according to any one of the preceding aspects from the 51st to the 63rd, the intercepting wall has one or more series of through holes.

In a 65th aspect according to the preceding aspect, each series of through holes includes through holes at a same angular distance from one another and positioned all around the impeller periphery.

In a 66th aspect according to any one of the preceding aspects from the 51st to the 65th, the through holes (101) are positioned on the intercepting wall (100) at two diametrically opposite sectors of the intercepting wall (100).

In a 66th aspect according to the preceding aspect, each sector includes a plurality of uniformly distributed through holes (101) and has an angular width of at least 90th.

In a 67th aspect according to any one of the preceding aspects from the 51st to the 66th, the through holes (101) are arranged one next to the other according to two or more patterns of through holes.

In a 68th aspect according to any one of the preceding aspects from the 52nd to the 67th, the annular flow volume of the first expansion chamber (31) has a transversal air flow cross sectional area, measured perpendicular to an axis of rotation (12*a*) of the impeller (12), having a prefixed maximum area.

In another aspect according to the preceding aspect, the annular flow volume of the first expansion chamber (31) has a transversal air flow cross sectional area, measured perpendicular to an axis of rotation (12*a*) of the impeller (12), having an annulus shape.

In a 69th aspect according to any one of the preceding aspects, the cleaning assembly (500) includes:

a chassis (138), a cleaning unit (50) mounted to the chassis (138) with at least one degree of freedom relative to the chassis (138) allowing the cleaning unit (50) to be lifted and lowered with respect to the chassis (138).

In a 70th aspect a floor cleaning apparatus is provided comprising:

a chassis (138), a cleaning unit (50) mounted to the chassis (138) with at least one degree of freedom relative to the chassis (138) allowing the cleaning unit (50) to be lifted and lowered relative to the chassis (138).

In a 71st aspect according to the 69th or the 70th aspect, the cleaning assembly (500) includes at least one suspension device (139) operatively active on the cleaning unit (50) and configured to transmit to the cleaning unit (50) an upwardly directed force.

In a 72nd aspect according to any one of the preceding aspects from the 69th to the 71st, the at least one suspension device (139) is interposed between the cleaning unit (50) and the chassis (138).

In a 73rd aspect according to any one of the preceding aspects from the 69th to the 72nd, the cleaning assembly (500) includes at least one mechanism (140) connecting a front end of the chassis (138) to a support framework (63) of the cleaning unit (50).

In a 74th aspect according to the preceding aspect, the mechanism (140) includes a first lever (141) having a first end (141*a*) coupled with the support framework (63) of the cleaning unit (50) and a second opposite end (141*b*) cinematically connected to the chassis (138).

In a 75th aspect according to the 73th or the 74th aspect, the mechanism (140) includes a second lever (142) having a first end (142*a*) coupled with the support framework (63) of the cleaning unit (50) and a second opposite end (142*b*) cinematically connected to the chassis (138).

In a 76th aspect according to the 74th or the 75th aspect, the first end (141*a*) of the first lever (141) is coupled, optionally pivotally coupled, to the support framework (63) of the cleaning unit (50) at a first coupling point (143).

In a 77th aspect according to the 75th or the 76th aspect, the first end (142*a*) of the second lever (142) is coupled, optionally pivotally coupled, to the support framework (63) of the cleaning unit (50) at a second coupling point (144).

In a 77th bis aspect according to the preceding aspect, the first coupling point (143) is at distance from and below the second coupling point (144).

In a 78th aspect according to any one of the preceding aspects from the 74th to the 77th bis, the second end (141*b*) of the first lever (141) is coupled, optionally pivotally coupled, at a third coupling point (145), to the chassis (138) or to an auxiliary support member (147) cinematically connected to the chassis (138).

In a 79th aspect according to any one of the preceding aspects from the 75th to the 78th, the second end (142*b*) of the second lever (142) is coupled, optionally pivotally coupled, to a fourth coupling point (146) to the chassis (138). In a sub-aspect according to the 79th aspect, the third coupling point (145) is at distance from and below the fourth coupling point.

In an 80th aspect according to any one of the three preceding aspects, the mechanism (140) includes the auxiliary support member (147), and wherein the auxiliary support member (147) has a front portion (147*a*), a rear portion (147*b*) and an intermediate portion (147*c*) extending between the front portion (147*a*) and the rear portion (147*b*).

In an 81st aspect according to the preceding aspect, the second end (141*b*) of the first lever (141) is coupled, optionally pivotally coupled, to said auxiliary support member (147) at said third coupling point (145) positioned at the front portion (147*a*) of the auxiliary support member (147).

In an 82nd aspect according to the 80th or the 81st aspect, the intermediate portion (147*c*) is coupled, optionally pivotally coupled, to the chassis (138) at a fifth coupling point (148).

In an 83rd aspect according to the preceding aspect, the rear portion (147*b*) carries an abutment (149) designated to cooperate with a corresponding abutment (150) of the chassis (138) to limit an angular stroke of the auxiliary support member (147) with respect to the chassis (138) and around said fifth coupling point (148).

In an 84th aspect according to the preceding aspect, the auxiliary support member (147) is angularly movable about the fifth coupling point (148) with respect to the chassis (138) from a first end stroke position, where the abutment (149) on the auxiliary support member (147) touches the abutment (150) on the chassis (138), to a second end stroke position, where the abutment (149) on the auxiliary support member (147) is angularly spaced from the abutment (150) on the chassis (138).

In an 85th aspect according to the preceding aspect, at said first end stroke position of the auxiliary support member (147), the cleaning unit (50) is in an operative cleaning position with an active portion (151) configured for contacting a floor to be cleaned.

In an 86th aspect according to the 84th or the 85th aspect, in correspondence of said second end stroke position of the auxiliary support member (147), the cleaning unit (50) is in a lifted rest position with respect to the cleaning position so as to prevent the active portion (151) from contacting the floor to be cleaned.

In an 87th aspect according to any one of the preceding aspects from the 84th to the 86th, the cleaning assembly (500) includes a pedal actuated leverage (152) active on said auxiliary support member (147) for moving said auxiliary support member (147) between said first end stroke position and said second end stroke position.

In an 88th aspect according to the preceding aspect, the pedal actuated leverage (152) includes:

a pedal actuated lever (153) with a pedal (154) at a first end (153*a*) and an intermediate portion (155) hinged to a lower portion (71) of the chassis (138), a transmission lever (156) having a first end (156*a*), hinged to a second end (153*b*) of the pedal lever (153), and a second end (156*b*) directly or indirectly active on said auxiliary support member (147).

In an 89th aspect according to the preceding aspect, the second end (156*b*) of the transmission lever (156) is hinged to a component (157) angularly fixed to the auxiliary support member (147).

In a 90th aspect according to any one of the preceding aspects from the 73th to the 89th, the at least a suspension device (139) is interposed between the cleaning unit (50) and the mechanism (140) connecting the front end of the chassis (138) to the support framework (63) of the cleaning unit (50).

In a 91st aspect according to any one of the preceding aspects from the 74th to the 90th, the at least one suspension device (139) includes one first end (139*a*) connected to an intermediate portion of the first lever (141) or of the/a second lever (142) and one opposite second end (139*b*) connected to the chassis (138) or the/an auxiliary support member (147).

In a 92nd aspect according to any one of the preceding aspects from the 78th to the 91st, the at least one suspension device (139) includes one first end (139*a*) connected to an intermediate portion of the first lever (141) and one opposite second end (139*b*) connected to the auxiliary support member (147).

In a 93rd aspect according to the preceding aspect, the second end (139*b*) of the at least one suspension device (139) is connected to the auxiliary support member (147) at a lower region (147*d*) of this latter.

In a 94th aspect according to the preceding aspect, the lower region (147*d*) of the auxiliary support member (147) extends below said fifth and third coupling points (148, 145) in both said first and second end stroke positions of the auxiliary support member (147).

In a 95th aspect according to the 93rd or the 94th aspect, the lower region (147*d*) of the auxiliary support member (147) extends downwards from the front portion (147*a*).

In a 96th aspect according to any one of the preceding aspects from the 91st to the 95th, the intermediate portion of the first lever (141) where the first end of the suspension device (139) is connected, extends above said fifth and third coupling points in both said first and second end stroke positions of the auxiliary support member (147).

In a 97th aspect according to any one of the preceding aspects from the 71st to the 96th, the at least one suspension device (139) includes a left suspension device (139') on a left side of the apparatus and a right suspension device (139") on a right side of the apparatus.

In a 98th aspect according to any one of the preceding aspects from the 73rd to the 97th, the at least one mechanism (140) includes a left mechanism on a left side of the apparatus and a right mechanism on a right side of the apparatus.

In a 99th aspect according to the two preceding aspects, the left suspension device (139') is interposed between a left side of the cleaning unit (50) and the left mechanism linking a forward left end of the chassis (138) to the support framework (63) of the cleaning unit (50). In a sub-aspect according to any one of the preceding aspects from the 97th to the 99th, the right suspension device (139") is interposed between a right side of the cleaning unit (50) and the right mechanism linking a forward right end of the chassis (138) to the cleaning unit (50) support framework (50).

In a 100th aspect according to the four preceding aspects, the left suspension device (139') is cinematically identical to the right suspension device (139") and the left mechanism is identical to the right mechanism.

In a 101st aspect according to any one of the preceding aspects from the 71st to the 100th, the suspension device (139) includes an elastic suspension device.

In a 102nd aspect according to any one of the preceding aspects from the 71st to the 101st, the suspension device includes a spring suspension or a pneumatic suspension.

In a 103rd aspect according to any one of the preceding aspects from the 71st to the 102nd, the suspension device is a pneumatic cylinder.

In a 104th aspect according to any one of the preceding aspects from the 71st to the 103rd, the suspension device (139) is configured for transmitting to the cleaning unit (50) an upwardly directed force not greater than the cleaning unit weight, optionally lower than 0.75 of the cleaning unit weight, more optionally in a range between 0.45 and 0.55 of the cleaning unit weight.

In a 105th aspect according to any one of the preceding aspects from the 69th to the 104th, the cleaning unit (50) is associated to an inferior portion (71) of the floor cleaning apparatus (1) and includes a left cleaning disc (51) and a right cleaning disc (52), each one of the left and right cleaning discs (51, 52) having a respective lower side (51*a*, 52*a*) configured for cleaning the floor and a respective upper side (51*b*, 52*b*) opposite the lower side, said cleaning unit (500) comprising also a motor assembly (53) configured to operate in rotation the left cleaning disc and the right cleaning disc (51, 52) around a respective axis of rotation (51*x*, 52*x*).

In a 106th aspect a floor cleaning apparatus (1) is provided comprising:

- a cleaning unit (50) associated to an inferior portion (71) of the floor cleaning apparatus (1) and comprising a left cleaning disc (51) and a right cleaning disc (52), each one of the left and right cleaning discs (51, 52) having a respective lower side (51*a*, 52*a*) configured to clean the floor and a respective upper side (51*b*, 52*b*) opposite the lower side;
- a motor assembly (53) configured to operate in rotation the left cleaning disc and the right cleaning disc (51, 52) around a respective axis of rotation (51*x*, 52*x*).

In a 107th aspect according to the 105th or the 106th aspect, the cleaning unit (50) includes at least one presser device (54) active on a peripheral portion of the upper side (51*b*) of the left cleaning disc (51) and on a peripheral portion of the upper side (52*b*) of the right cleaning disc (52).

In a 108th aspect according to the preceding aspect, the presser device (54) includes a left presser (55) active on the peripheral portion of the upper side (51*b*) of the left cleaning disc (51) and a right presser (56) active on a peripheral portion of the upper side (52*b*) of the right cleaning disc (52).

In a 109th aspect according to the preceding aspect, the left presser (55) is exclusively active on the peripheral portion, which is in the form of a peripheral band, of the upper side (51*b*) of the left cleaning disc (51).

In a 110th aspect according to the preceding aspect, the peripheral band of the upper side (51*b*) of the left cleaning disc (51) is planar and has the form of an annulus concentric to the axis of rotation (51*x*) of the left cleaning disc (51).

In a 111st aspect according to any one of the preceding aspects from the 108th to the 110th, the right presser (56) is exclusively active on the peripheral portion, which is in the form of a peripheral band, of the upper side (52*b*) of the right cleaning disc (52).

In a 112nd aspect according to the preceding aspect, the peripheral band of the upper side (52*b*) of the right cleaning disc (52) is planar and has the form of an annulus concentric to the axis of rotation (52*x*) of the right cleaning disc (52).

In a 113rd aspect according to any one of the preceding aspects from the 107th to the 112th, the presser device (54) is elastically pushed towards the upper side of each one of the left and right cleaning discs (51, 52).

In a 114th aspect according to any one of the preceding aspects from the 108th to the 113th, the left presser (55) is elastically pushed towards the peripheral portion of the upper side (51*b*) of the left cleaning disc (51) and the right presser (56) is elastically pushed towards the peripheral portion of the upper side (52*b*) of the right cleaning disc (52).

In a 115th aspect according to any one of the preceding aspects from the 108th to the 114th, each one of said left presser (55) and right presser (56) includes a contact element (57) active on the/a peripheral portion, optionally on the/a peripheral band, of the upper side (51*b*, 52*b*) of the respective one of said left cleaning disc (51) and right cleaning disc (52). In a sub-aspect according to the 115th aspect, each one of said left presser (55) and right presser (56) includes a support structure (58) carrying the contact element (57).

In a 116th aspect according to the preceding aspect, the support structure (58) includes:

a holding body (59), at least one lever (60) interposed between the holding body (59) and the contact element (57), said lever (60) having a superior portion (60*a*) hinged to the holding body (59) and an inferior portion (60*b*) carrying the contact element (57).

In a 117th aspect according to the preceding aspect, the support structure (58) includes a spring (61) interposed between the holding body (59) and the lever (60) and configured to push the lever towards the upper side (51*b*, 52*b*) of the respective left or right cleaning disc (51, 52).

In a 118th aspect according to the preceding aspect, the spring (61) is a torsional spring having one end (61*a*) acting on the lever (60) and one opposite end (61*b*) acting on the holding body (59).

In a 119th aspect according to any one of the four preceding aspects, the support structure (58) includes two parallel levers (60) having the/two superior portions (60*a*) hinged to the/a holding body and the inferior portions (60*b*) forming a fork carrying the contact element (57).

In a 120th aspect according to any one of the preceding aspects from the 115th to the 119th, the left presser (55) acts on the upper side of the peripheral portion of the left cleaning disc (51), with the peripheral portion of the left cleaning disc (51) rotatable under and in contact with the contact element (57) of the left presser (55).

In a 121st aspect according to any one of the preceding aspects from the 115th to the 120th, the right presser (56) acts on the upper side of the peripheral portion of the right cleaning disc (52), with the peripheral portion of the right cleaning disc (52) being rotatable under and in contact with the contact element (57) of the right presser (56). In a sub-aspect according to any one of the 120th or 121st aspects, the left presser (55) acts exclusively on an area of the peripheral portion of the upper side (51*b*) of the left cleaning disc (51) and the right presser (56) acts exclusively on an area of the peripheral portion of the upper side (52*b*) of the right cleaning disc (52), said areas being adjacent to each other and extending at or near a centerline plane (L) of the apparatus.

In a 122nd aspect according to any one of the preceding aspects from the 116th to the 121st, the contact element (57) includes a rotating element, optionally a wheel, rotatably engaged to the inferior portion (60*b*) of the lever (60).

In a 123rd aspect according to any one of the preceding aspects from the 119th to the 122nd, each contact element (57) includes a wheel rotatably engaged to the inferior portion of two parallel levers (60) through an axle (62) pivotally engaged to the fork.

In a 124th aspect according to the preceding aspect, the wheel is mounted by rotation around a horizontal axis (57*x*) parallel to the plane of the peripheral band and/or the axes of rotation (51*x*, 52*x*) of the left and right cleaning discs (51, 52) are vertical.

In a 126th aspect according to any one of the preceding aspects from the 116th to the 124th, the holding body (59) of the left presser (55) and the holding body (59) of the right presser (56) are rigidly connected, optionally formed in a single piece, and are mounted to a support framework (63) of the cleaning unit (50).

In a 127th aspect according to any one of the preceding aspects from the 105th to the 126th, the left and right cleaning discs (51, 52) are offset with respect to a direction of travel (D) of the floor cleaning apparatus during operation.

In a 128th aspect according to any one of the preceding aspects from the 105th to the 127th, the left and right cleaning discs (51, 52) are mounted in the cleaning unit (50) such that a centerline (C) running through the centers (51*c*, 52*c*) of the left and right cleaning discs is not perpendicular to a longitudinal centerline (L) of the apparatus.

In a 129th aspect according to any one of the two preceding aspects, the contact element (57) of the left presser (55) and the contact element (57) of the right presser (56) are offset with respect to a/the direction of travel (D) of the floor cleaning apparatus during operation.

In a 130th aspect according to any one of the preceding aspects from the 124th to the 129th, the axis of rotation (57*x*) of the contact element (57) of the left presser (55) is perpendicular to a/the direction of travel (D) of the floor cleaning apparatus during operation.

In a 131st aspect according to any one of the preceding aspects from the 124th to the 130th, the axis of rotation (57*x*) of the contact element (57) of the right presser (56) is perpendicular to a/the direction of travel (D) of the floor cleaning apparatus during operation.

In a 131st bis aspect according to any one of the preceding aspects from the 128th to the 130th, the area where the right presser (56) acts under pressure is a section of the perimeter portion of the right cleaning disc (52) slightly rearward with respect to a centerline (C) that intersects the peripheral band of the upper side (52*b*) of the right cleaning disc (52), whereas the area where the left presser (55) acts under pressure is a section of the perimeter portion slightly advanced with respect to a centerline (C) that intersects the peripheral band of the upper side (51*b*) of the left disc (51).

In a 131st ter aspect according to any one of the preceding aspects from the 128th to the 131st bis, the area where the right presser (56) acts under pressure is a section of the perimeter portion of the right cleaning disc (52) slightly forward with respect to a centerline (C) that intersects the peripheral band of the upper side (52*b*) of the right cleaning disc (52), whereas the area where the left presser (55) acts under pressure is a section of the perimeter portion slightly rearward with respect to a centerline (C) that intersects the peripheral band of the upper side (51*b*) of the left cleaning disc (51).

In a 132nd aspect according to any one of the preceding aspects from the 105th to the 131st ter, the motor assembly (53) is configured to turn the left and right cleaning discs (51, 52) according to opposite directions of rotation.

In a 133rd aspect according to any one of the preceding aspects from the 105th to the 132nd, the cleaning assembly (500) includes main wheels (64) mounted to the inferior portion (71) of the housing (70) for rotation according to a horizontal axis and oriented for moving the floor cleaning apparatus (1) along said direction of travel (D).

In a 134th aspect according to any one of the preceding aspects from the 69th to the 104th, the cleaning unit (50) has:

a support framework (63), at least one cleaner roller (110), a first and a second connector (111, 112) interposed between the support framework (63) and opposite ends of the cleaner roller (110), in order to rotatably engage the cleaner roller (110) itself with the support framework (63) around a substantially horizontal axis of rotation (X), wherein at least one between the first and the second connector (111, 112) includes a male component (113) and a female component (114) coupled together in a removable manner.

In a 135th aspect a floor cleaning apparatus (1) is provided comprising at least one cleaning unit (50) intended to act on a floor to be cleaned, wherein said cleaning unit (50) has:

a support framework (63), at least one cleaner roller (110), a first and a second connector (111, 112) interposed between the support framework (63) and opposite ends of the cleaner roller (110), in order to rotatably engage the cleaner roller (110) itself with the support framework (63) around a substantially horizontal axis of rotation (X), wherein at least one between the first and the second connector (111, 112) include a male component (113) and a female component (114) coupled together in a removable manner.

In a 136th aspect according to the 134th or the 135th aspect, the male component (113) has at least one base (115) having at least one radial projection (116) configured for engaging the female component (114) and preventing a relative rotation between the male component (113) and the female component (114).

In a 137th aspect according to any one of the preceding aspects from the 134th to the 136th, the male component (113) has at least one invitation portion (117) extended as a prolongation of the base (115) along the axis of rotation (X), wherein said invitation portion (117) has a tapered shape moving away from said base (115) and it is configured for guiding the male component (113) in at least partial insertion within the female component (114).

In a 138th aspect according to any one of the preceding aspects from the 136th to the 137th, the base (115) has a central body with cylindrical lateral wall (119) coaxial with said axis of rotation (X) and wherein at least one radial projection (116) emerges from the lateral wall (119) of said central body.

In a 139th aspect according to any one of the preceding aspects from the 136th to the 138th, the base (115) includes a plurality of radial projections (116) angularly offset from each other by an angle comprised between 30° and 90°.

In a 140th aspect according to the preceding aspect, each radial projection (116) emerges from the cylindrical lateral wall (119).

In a 141st aspect according to any one of the two preceding aspects, each radial projection (116) extends along a direction parallel to the axis of rotation (X).

In a 142nd aspect according to any one of the three preceding aspects, each radial projection (116) has:

a main portion (116*a*), an end portion (116*b*), following the main portion (116*a*) and facing the invitation portion (117).

In a sub-aspect according to the 142nd aspect, the end portion (116*b*) has a tapered shape configured for guiding each radial projection (116) in engagement within a respective indentation (120), optionally shaped as a groove, of the female component (114).

In a 143rd aspect according to any one of the preceding aspects from the 139th to the 142nd, each radial projection (116) has, at the external surface of the lateral wall (119) of the central body, an angular extension comprised between 0° and 20°, optionally between 2° and 20°.

In a 144th aspect according to any one of the preceding aspects from the 142nd to the 143rd, the main portion (116*a*) of each of said radial projections (116) is laterally delimited by sides (121*a*) parallel to each other or slightly converging moving away from the axis of rotation.

In a 145th aspect according to any one of the preceding aspects from the 142nd to the 144th, the end portion (116*b*) of each of said radial projections (116) is laterally delimited by sides (121*b*) converging with respect to each other approaching the invitation portion.

In a 146th aspect according to any one of the preceding aspects from the 142nd to the 145th, the end portion (116*b*) of each radial projection (116) has an angular extension decreasing approaching the invitation portion (117).

In a 147th aspect according to the 145th or the 146th aspect, the converging sides (121*b*) of the end portion (116*b*) of each radial projection (116) are incident with respect to each other at the invitation portion (117) to define a sharp or smoothed edge.

In a 148th aspect according to the preceding aspect, the converging sides (121*b*) of the end portion (116*b*) of each radial projection (116) form an angle comprised between 10° and 90°.

In a 149th aspect according to any one of the preceding aspects from the 139th to the 148th, each radial projection (116) is superiorly delimited by a top wall (122) having a curvilinear shape.

In another aspect according to the preceding aspect, the top wall (122) has a concavity directed towards the axis of rotation (X).

In a 150th aspect according to any one of the two preceding aspects, the top walls (122) of the radial projections (166) lie on a same ideal cylindrical surface.

In a 151st aspect according to any one of the preceding aspects from the 139th to the 150th, the male component (113) has at least one recess (123) in interposition between two angularly successive radial projections (116), said recess (123) being configured for receiving, in engagement, a radial counter-projection (124) of the female component (114).

In a 152nd aspect according to the preceding aspect, each recess (123) of the male component (113) is inferiorly delimited by the lateral wall (119) of the central body (118).

In a 153rd aspect according to the 151st or the 152nd aspect, each said recess (123) of the male component (113) is at least partly counter-shaped to the radial counter-projection (124) of the female component (114).

In a 154th aspect according to any one of the preceding aspects from the 137th to the 153rd, the invitation portion (117) has an external surface converging moving away from the base (115).

In a 155th aspect according to any one of the preceding aspects from the 137th to the 154th, the invitation portion (117) has a conical or frustoconical shape.

In a 156th aspect according to any one of the preceding aspects from the 137th to the 155th, the male component (113) has at least one attachment flange (125) emerging from the base (115) on the side opposite the invitation portion (117).

In a 157th aspect according to the preceding aspect, the attachment flange (125) is torsionally couplable to at least one between a drive shaft or a motorized component (126).

In a 158th aspect according to the 156th or the 157th aspect, the attachment flange (125) radially projects with respect to each of said radial projections (116).

In a 159th aspect according to any one of the preceding aspects from the 137th to the 158th, the base (115) has at least one cavity (127) extending starting from one end of the base (115) opposite to the invitation portion (117) in the direction of the latter.

In a 160th aspect according to the preceding aspect, the cavity (127) defines a passage suitable to allow the insertion of a portion of the drive shaft or of the motorized component (126).

In a 161st aspect according to the 159th or the 160th aspect, the base (115) has at least one through hole (128) facing the cavity (127) in order to allow the insertion of at least one constraint element configured for blocking the male component (113) with respect to said portion of the drive shaft or of the motorized component (126).

In a 162nd aspect according to the preceding aspect, the through hole is defined at one of said recesses (123), in interposition between two angularly successive radial projections (116).

In a 163rd aspect according to any one of the preceding aspects from the 159th to the 162nd, the male component (113) has a first and a second through hole facing the cavity (127) and aligned with each other along a same radial direction incident on the axis of rotation (X).

In a 164th aspect according to the preceding aspect, the first and the second through hole define a respective passage suitable to allow the insertion of at least one constraint element configured for blocking the male component (113) with respect to said portion of the drive shaft or of the motorized component (126).

In a 165th aspect according to the 163rd or the 164th aspect, the first and the second through holes are radially opposite to each other with respect to the axis of rotation (X).

In a 166th aspect according to any one of the preceding aspects from the 134th to the 165th, the female component (114) includes a main body (129) defining an internal volume for at least partly housing the male component (113).

In a 167th aspect according to the preceding aspect, the main body (129) has a radial shoulder (130) at a passage opening (131) to the internal volume, said radial shoulder (130) being configured for acting in abutment against a terminal edge of the cleaner roller (110).

In a 168th aspect according to the two preceding aspects, the female component (114) engages the cleaner roller (110) at one end of the latter, with an external wall (132), optionally cylindrical, of the main body (129) which is inserted in a corresponding cavity of the cleaner roller (110).

In a 169th aspect according to any one of the preceding aspects from the 166th to the 168th aspect when depending on the 151st aspect, each radial counter-projection (124) emerges from the main body (129) towards the internal volume, each radial counter-projection (124) being configured for being arranged in insertion within a respective recess (123) of the male component (113).

In a 170th aspect according to any one of the preceding aspects from the 166th to the 169th, the female component has a plurality of radial counter-projection (124), emerging from the main body (129), angularly offset from each other by an angle comprised between 30° and 90°.

In a 171st aspect according to the preceding aspect, each radial counter-projection (124) extends along a direction parallel to the axis of rotation (X).

In a 172nd aspect according to the 170th or the 171st aspect, the radial counter-projection (124) has:

a main portion (124*a*), an end portion (124*b*), following the main portion (124*a*) and facing the passage opening (131).

In a 173rd aspect according to the preceding aspect, the end portion (124*b*) has a tapered shape configured for guiding the radial counter-projection (124) in engagement within the respective recess (123) of the male component (113).

In a 174th aspect according to any one of the preceding aspects from the 170th to 173rd, each radial counter-projection (124) has, at the internal surface of the external wall (132) of the main body (129), an angular extension comprised between 0° and 20°, optionally between 2° and 20°.

In a 175th aspect according to any one of the preceding aspects from the 172nd to the 174th, the main portion (124*a*) of each of said radial counter-projections (124) is laterally delimited by sides (133*a*) converging with respect to each other proceeding radially towards the axis of rotation (X).

In un 176th aspect according to any one of the preceding aspects from the 172nd to the 175th, the end portion (124*b*) of each of said radial counter-projections (124) is laterally delimited by sides (133*b*) converging with respect to each other, both proceeding radially towards the axis of rotation (X), and proceeding approaching the passage opening.

In a 177th aspect according to any one of the preceding aspects from the 172nd to the 176th, the end portion (124*b*) of each radial counter-projection (124) of the female component (114) has an angular extension decreasing approaching the passage opening (131).

In a 178th aspect according to the 176th or the 177th aspect, the converging sides (133*b*) of the end portion (124*b*) of each radial counter-projection (124) are incident with respect to each other at the passage opening (131) to define a sharp or smoothed edge.

In a 179th aspect according to any one of the preceding aspects from the 176th to the 178th, the converging sides (133*b*) of the end portion (124*b*) of each radial counter-projection (124) form an angle comprised between 10° and 90°.

In a 180th aspect according to any one of the preceding aspects from the 170th to the 179th, each radial counter-projection (124) is superiorly delimited by a top wall (134) having a curvilinear shape.

In a 181st aspect according to the preceding aspect, the top wall (134) of the radial counter-projection (124) has a concavity directed towards the internal volume of the main body (129).

In a 182nd aspect according to the 180th or the 181st aspect, the top walls (134) of the radial counter-projections (124) lie on a same ideal cylindrical surface.

In a 183rd aspect according to any one of the preceding aspects from the 170th to 182nd, the female component (114) has an indentation (120) defined in interposition between two angularly successive radial counter-projections (124), said indentation (120) being configured to receive, in engagement, a respective radial projection (116) of the male component (113).

In a 184th aspect according to any one of the preceding aspects from the 175th to the 183rd, the sides (133*a*) of the main portion (124*a*) of each counter-projection (124) diverge from each other moving away from the passage opening (131), conferring to each indentation (120) an angular extension progressively reducing, always moving away from the passage opening.

In a 185th aspect according to the two preceding aspects, each indentation (120) has an angular width, measured on the internal surface of the external wall (132), which is reduced by a value comprised from 1° to 3°, following the entire extension of the main portion (124*a*) of the radial counter-projections (124) adjacent to the same indentation (120).

In a 186th aspect according to any one of the three preceding aspects, the indentation (120) of the female component (114) is inferiorly delimited by the internal surface of the external wall (132).

In a 187th aspect according to any one of the four preceding aspects, the indentations (120) of the female component (114) are at least partly counter-shaped with respect to a respective radial projection (116) of the male component (113).

In a 188th aspect according to any one of the preceding aspects from the 134th to the 187th, the first connector (111) includes the male component (113) and the female component (114).

In a 189th aspect according to any one of the preceding aspects from the 134th to the 188th, the cleaning unit (50) includes at least one casing (135) carried by the support framework (63), said casing (135) delimiting a compartment suitable for housing the cleaner roller (110).

In a 190th aspect according to the preceding aspect, the casing (135) has at least one hatch (136) removably engaged to the casing (135) and configured to allow a user to reach the compartment; or a flap hinged to the casing (135) and configured when in open position to allow a user to reach the compartment.

In a 191st aspect according to any one of the preceding aspects from the 134th to the 190th, at least one between the male component (113) or the female component (114) of the second connector (112) is engaged with the hatch (136) or with the flap and is movable by rotation relative to the latter.

In a 192nd aspect according to any one of the preceding aspects from the 134th to the 191st, the male component (113) or female component (114) of the second connector (112) are removably engageable with a corresponding element, respectively female or male, carried by the cleaner roller (110) at one end of the latter opposite to that at which the first connector (111) operates.

In a 193rd aspect according to any one of the preceding aspects from the 134th to the 192nd, the cleaning unit includes two cleaner rollers (110) engageable with respective first and second connectors (111, 112).

In a 194th aspect according to the preceding aspect, the cleaner rollers (110) are movable by rotation around respective horizontal axes of rotation parallel to each other.

In a 195th aspect according to any one of the preceding aspects from the 160th to the 194th, the cleaning unit (50) includes at least one motor (137) carried by the support framework (63) directly engageable with the male component (113), or indirectly engageable with the same male component (113) through the/a motorized component (126).

In a 197th aspect one cleaner roller (110) is provided comprising, at one end thereof, one among:

a male component (113) having:

at least one base (115) having at least one radial projection (116) configured for engaging the female component (114) and preventing a relative rotation between the male component (113) and the female component (114), at least one invitation portion (117) extended as a prolongation of the base (115), wherein said invitation portion (117) has a tapered shape moving away from said base (115) and is configured for guiding the male component (113) in at least partial insertion within the female component (114), or a female component (114) having:

a main body (129) defining an internal volume for at least partly housing a male component (113), at least an indentation (120), optionally shaped as a groove, defined on the main body (129), at least partly counter-shaped with respect to at least a radial counter-projection (116) of the male component (113).

In a 198th aspect according to the preceding aspect the cleaner roller includes at its end the male component, wherein the base (115) has a central body with cylindrical lateral wall (119) coaxial with said axis of rotation (X) and wherein said at least one radial projection (116) emerges from the lateral wall (119) of said central body.

In a 199th aspect according to the 197th or the 198th aspect, the base (115) includes a plurality of radial projections (116) angularly offset from each other by an angle comprised between 30° and 90°.

In a 200th aspect according to the 198th or the 199th aspect, each radial projection (116) emerges from the cylindrical lateral wall (119).

In a 201 st aspect according to the 197th to the 200th aspect, each radial projection (116) extends along a direction parallel to the axis of rotation (X).

In a 202nd aspect according to any one of the preceding aspects from the 197th to the 201st, each projection (116) has:

a main portion (116*a*), an end portion (116*b*), following the main portion (116*a*) and facing at the invitation portion (117).

In a sub-aspect according to the 202nd aspect, the end portion (116*b*) end portion (116*b*) has a tapered shape configured for guiding each radial projection (116) in engagement within a respective indentation (120), optionally shaped as a groove, of the female component (114).

In a 203rd aspect according to any one of the preceding aspects from the 198th to the 202nd, each radial projection (116) has, at the external surface of the lateral wall (119) of the central body, an angular extension comprised between 0° and 20°, optionally between 2° and 20°.

In a 204th aspect according to the 202nd or the 203rd aspect, the main portion (116*a*) of each of said radial projections (116) is laterally delimited by sides (121*a*) parallel to each other or slightly converging moving away from the axis of rotation.

In a 205th aspect according to any one of the preceding aspects from the 202nd to the 204th, the end portion (116*b*) of each of said radial projections (116) is laterally delimited by sides (121*b*) converging with respect to each other approaching the invitation portion.

In a 206th aspect according to any one of the preceding aspects from the 203rd to the 205th, the angular extension of the end portion (116*b*) of each radial projection (116) is decreasing approaching the invitation portion (117).

In a 207th aspect according to the 205th or the 206th aspect, the converging sides (121*b*) of the end portion (116*b*) of each radial projection (116) are incident with respect to each other at the invitation portion (117) to define a sharp or smoothed edge.

In a 208th aspect according to any one of the preceding aspects from the 205th to the 207th, the converging sides of the end portion (116*b*) of each radial projection (116) form an angle comprised between 10° and 90°.

In a 209th aspect according to any one of the preceding aspects from the 197th to the 208th, each radial projection (116) is superiorly delimited by a top wall (122) having a curvilinear shape, with concavity directed towards the axis of rotation (X).

In a 210th aspect according to the preceding aspect, the top walls (122) of the radial projections (166) lie on a same ideal cylindrical surface.

In a 211st aspect according to any one of the preceding aspects from the 197th to the 210th, the male component (113) has at least one recess (123) in interposition between two angularly successive radial projections (116), said recess (123) being configured for receiving in engagement a radial counter-projection (124) of the female component (114).

In a 212nd aspect according to the preceding aspect, each recess (123) of the male component (113) is inferiorly delimited by the lateral wall (119) of the central body (118).

In a 213rd aspect according to the 211th or the 212th aspect, each said recess (123) of the male component (113) is at least partly counter-shaped with respect to the radial counter-projection (124) of the female component (114).

In a 214th aspect according to any one of the preceding aspects from the 197th to the 213th, the invitation portion (117) has an external surface converging moving away from the base (115).

In a 215th aspect according to any one of the preceding aspects from the 197th to the 214th, the invitation portion (117) has a conical or frustoconical shape.

In a 216th aspect according to any one of the preceding aspects from the 197th to the 215th, the male component (113) has at least one attachment flange (125) emerging from the base (115) on the side opposite to the invitation portion (117).

In a 217th aspect according to the preceding aspect, the attachment flange (125) is torsionally couplable to at least one between a drive shaft or a motorized component (126).

In a 218th aspect according to the 216th or the 217th aspect, the attachment flange (125) radially projects with respect to each of said radial projections.

In a 219th aspect according to any one of the preceding aspects from the 197th to the 218th, the base (115) has at least one cavity (127) extended starting from one end of the base (115) opposite to the invitation portion (117) in the direction of the latter.

In a 220th aspect according to the preceding aspect, the cavity (127) defines a passage suitable for allowing the insertion of a portion of the drive shaft or of the motorized component (126).

In a 221st aspect according to the 219th or the 220th aspect, the base (115) has at least one through hole (128) facing the cavity (127) in order to allow the insertion of at least one constraint element configured for blocking the male component (113) with respect to said portion of the drive shaft or of the motorized component (126).

In a 222nd aspect according to the preceding aspect, the through hole is defined at one of said recesses (123), in interposition between two angularly successive radial projections (116).

In a 223rd aspect according to the 221st or the 222nd aspect, the male component (113) has a first and a second through hole aligned with each other along a same radial direction incident on the axis of rotation (X).

In a 224th aspect according to the preceding aspect, the first and second through holes both face the cavity (127) such as to define a respective passage suitable for allowing the insertion of at least one constraint element configured for blocking the male component (113) with respect to said portion of the drive shaft or of the motorized component (126).

In a 225th aspect according to the 223rd or the 224th aspect, the first and the second through hole are radially opposite to each other with respect to the axis of rotation (X).

In a 226th aspect according to the 197th aspect, the cleaner roller includes at the end the female component (114), wherein the main body (129) defines an internal volume for at least partly housing the male component (113).

In a 227th aspect according to the preceding aspect, the main body (129) has a radial shoulder (130) at a passage opening (131) to the internal volume, said radial shoulder (130) being configured for acting in abutment against a terminal edge of the cleaner roller (110).

In a 228th aspect according to any one of the preceding aspects from the 226th to the 227th, the female component (114) engages the cleaner roller (110) at one end of an external wall (132), optionally cylindrical, of the main body (129) which is inserted in a corresponding cavity of the cleaner roller (110).

In a 229th aspect according to the 226th or the 228th aspect, the female component includes a plurality of radial counter-projections (124), emerging from the main body (129) towards the internal volume, each radial counter-projection (124) being configured for being insertingly arranged within a respective recess (123) of the male component (113).

In a 230th aspect according to the preceding aspect, the radial counter-projections (124) are angularly offset from each other by an angle comprised between 30° and 90°.

In a 231st aspect according to the 229th or the 230th aspect, each radial counter-projection (124) extends along a direction parallel to the axis of rotation (X).

In a 232nd aspect according to any one of the preceding aspects from the 229th to the 231 st, the radial counter-projection (124) has:

a main portion (124*a*), an end portion (124*b*), following the main portion (124*a*) and facing at the passage opening (131).

In a 223nd aspect according to the preceding aspect, the end portion (124*b*) has a tapered shape configured for guiding the radial counter-projection (124) in engagement within the respective recess (123) of the male component (113).

In a 234th aspect according to any one of the preceding aspects from the 229th to the 223rd, each radial counter-projection (124) has, at the internal surface of the external wall (132) of the main body (129), an angular extension comprised between 0° and 20°, optionally between 2° and 20°.

In a 235th aspect according to any one of the preceding aspects from the 232nd to the 234th, the main portion (124*a*) of each of said radial counter-projections (124) is laterally delimited by sides (133*a*) converging with respect to each other radially proceeding towards the axis of rotation (X).

In a 236th aspect according to any one of the preceding aspects from the 232nd to the 235th, the end portion (124*b*) of each of said radial counter-projections (124) is laterally delimited by sides (133*b*) converging with respect to each other proceeding radially towards the axis of rotation (X).

In another aspect according to the preceding aspect, the sides (133*b*) of the end portion (124*b*) are converging with respect to each other proceeding radially approaching the passage opening.

In a 237th aspect according to any one of the preceding aspects from the 232nd to the 236th, the end portion (124*b*) of each radial counter-projection (124) of the female component (114) has an angular extension decreasing approaching the passage opening (131).

In a 238th aspect according to the 236th or the 237th aspect, the converging sides (133*b*) of the end portion (124*b*) of each radial counter-projection (124) are incident with respect to each other at the passage opening (131) to define a sharp or smoothed edge.

In a 239th aspect according to any one of the preceding aspects from the 236th to the 238th, the converging sides (133*b*) of the end portion (124*b*) of each radial counter-projection (124) form an angle comprised between 10° and 90°.

In a 240th aspect according to any one of the preceding aspects from the 229th to the 239th, each radial counter-projection (124) is superiorly delimited by a top wall (134) having a curvilinear shape.

In a 241st aspect according to the preceding aspect, the top wall (134) of the radial counter-projection (124) has a concavity directed towards the internal volume of the main body (129).

In a 242nd aspect according to the 240th or the 241st aspect, the top walls (134) of the radial counter-projections (124) lie on a same ideal cylindrical surface.

In a 243rd aspect according to any one of the preceding aspects from the 229th to the 242nd, the female component (114) has at least an indentation (120) defined in interposition between two angularly successive radial counter-projections (124).

In a 244th aspect according to any one of the preceding aspects from the 235th to the 243rd, the sides (133*a*) of the main portion (124*a*) of each counter-projection (124) diverge from each other proceeding moving away from the passage opening (131), conferring to each indentation (120) an angular extension that is progressively reducing, always moving away from the passage opening.

In a 245th aspect according to the 243rd or the 244th aspect, the angular width of each indentation (120), measured on the internal surface of the external wall (132), reduces by a value comprised from 1° to 3°, following the entire extension of the main portion (124*a*) of the radial counter-projections (124) adjacent to the same indentation (120).

In a 246th aspect according to any one of the preceding aspects from the 243rd to the 245th, the indentation (120) of the female component (114) is inferiorly delimited by the internal surface of the external wall (132).

In the following description and in the claims the terms listed below have the following specific meaning.

Vertical, horizontal, up, down, upwards, downwards: these terms refer to a normal operating condition of the apparatus during use.

Upstream and downstream: refer to the position of the parts in relation to the airflow during operation of the exhaust unit and the suction unit parts of the apparatus.

Some components may only be represented schematically and may not be to scale.

With reference to the attached figures, it is described a floor cleaning apparatus 1. The apparatus 1 includes a supporting chassis 138 defining at least one housing 70 where the various internal components of the apparatus are housed. The chassis 138 supports a cleaning assembly 500; the cleaning assembly 500 is associated to an inferior portion of the apparatus 1 to be able to act on the floor to be cleaned. The cleaning assembly 500 includes a cleaning unit 50 which in the shown non-limiting examples operates at a front area of the apparatus 1 and which, as it will be better detailed below, may include, depending on the embodiments, one or more cleaning discs and/or one or more cleaner rollers. The cleaning assembly 500 of FIG. 1 includes preferably also an auxiliary cleaning unit 50', for example operating in a rear area of the cleaning assembly 500. In an aspect, the auxiliary cleaning unit 50' includes at least a hood or suction aperture 42 headed by a suction pipe 41 which brings air and any liquid particles from the cleaning assembly 500 to an upper area of the apparatus where a suction unit 10 operates. The apparatus 1 may for example also be equipped with one or more floor wipers (for example comprising a sheet with a rubber or silicone edge intended to contact the floor surface): in this case the hood or suction aperture 42 is located in front of the floor wiper and is designed to suck air and liquid particles from the portion of the floor surface in front of the floor wiper. Furthermore, the cleaning assembly 500 may include one or more containers 76', 76", 76''' for housing water, detergent or disinfectant liquids, concentrated liquids, etc., which may be distributed by one or more delivery channels 77 to the cleaning unit 50 and/or directly to the floor. In a per se conventional and non-limiting way, the apparatus 1 also includes main wheels 64 mounted on the inferior portion 71 of the housing 70 for rotation according to a horizontal axis and oriented to move the floor cleaning apparatus 1 along a direction of travel D. One or more auxiliary wheels 65 may also be provided to assist in the support and motion of the apparatus 1.

According to an aspect, the apparatus 1 includes a suction unit 10 provided with at least a motor 11 and with at least a fan or impeller 12 coupled with the motor 11; an inlet channeling unit 20 puts in fluid communication the suction pipe 41 with an inlet side of the suction unit, in order to suck in air, debris and possible liquid particles. In the example of FIG. 1, a spent liquid receptacle 75 is housed inside the housing 70: in this case, the inlet channeling unit 20 is positioned on the spent liquid receptacle 75 and the suction pipe 41 connects said at least mentioned portion of the cleaning assembly 500, i.e. the hood or suction aperture 42, with the spent liquid receptacle 75; practically, the suction unit 10 creates a suction force through the inlet channeling unit 20 which recalls the fluid through the suction pipe 41: the liquid and the sucked-in debris particles tend, thanks to the geometry and position of the various parts, to deposit in the spent liquid receptacle. Obviously, other known systems for collecting sucked-in particles, such as filter bags or others, may be provided.

According to a further aspect, independent or combinable with the aspects described here, the inlet channeling unit 20 may have the configuration hereinafter described. Optionally, the unit 20 may include a collector 21 facing on the container 75 and having a suction port 22 and a deflector 23, which extends radially at least on a central portion of the suction port: more in detail—in the reported example—the collector 21 and the deflector 23 delimit a suction channel 24 which puts in fluid communication the suction port 22 with the inlet of the suction unit 10. As it may be seen in particular from FIG. 3, the air flow entering through the suction port 22 is diverted by the deflector 23 towards a perimeter area where the suction channel 24 shows a first section 25 which begins immediately downstream of the suction port and extends upwards, a second consecutive section 26 and downstream of the first section 25 and which extends downwards and radially inwards, and a third section 27, consecutive and downstream of the second section 26, directed upwards and which puts in fluid communication an end of the second section 26 with the inlet of the suction unit 10. According to a further aspect of the present disclosure, the sections 25, 26 and 27 are configured as follows: the first section 25 defines a flow volume of tubular shape and has—in the direction of flow (i.e. moving upwards with reference to the drawing of FIG. 3)—a continuously decreasing fluid passage section; the second section 26 which is directly consecutive to the first section also defines a flow volume of tubular shape and has a continuously decreasing fluid passage section in the direction of flow (i.e. moving downwards and radially inwards with reference to the drawing of FIG. 3); the third section 27 defines a flow volume of non-tubular configuration with a substantially constant section. In a variant also the third section may have a tubular configuration. Practically the air is sucked-in through the relatively large suction port 22. Then the air impacts on the surface of the deflector 23 and is diverted into the suction channel 24 where the air flow takes the form of a continuous, up and down tubular flow volume along the first and second section 36, 37 undergoing an acceleration, a deviation of about 180° a deceleration and a new acceleration. Then the tubular flow volume converges into a non-tubular air flow volume when it reaches the third section and subsequently reaches the suction unit. Once the suction unit is reached, the air is pushed peripherally by the impeller 21 and does not hit the motor whereas reaching the outlet channeling unit 30.

The outlet channeling unit 30 connects an outlet side of the suction unit 10 (i.e. it receives the fluid, for example air and any liquid particles exiting the periphery of the impeller) with an exhaust aperture 40 of the cleaning apparatus 1. The outlet channeling unit 30 includes a first expansion chamber 31, a second expansion chamber 32 positioned downstream of the first expansion chamber 31 and a first compression channel or orifice 33 which puts in fluid communication the first expansion chamber 31 with the second expansion chamber 32. The first compression channel or orifice may have a certain extension in the direction of the flow (and therefore have the configuration of a real channel) or simply be a diaphragm with an orifice that therefore has a limited extension in the direction of the flow, but is nevertheless capable of exerting a compression on the flow passing thereby. The outlet channeling may also include a third expansion chamber 34 positioned downstream of the second expansion chamber 32, and a second compression channel or orifice 35 which puts in fluid communication the second expansion chamber 32 with the third expansion chamber 34. The second compression channel or orifice 35 may have a certain extension in the direction of the flow (and therefore have the configuration of a real channel) or simply be a diaphragm with an orifice that therefore has a limited extension in the direction of the flow, but is nevertheless capable of exerting a compression on the flow passing thereby. Finally, downstream of the third expansion chamber, the channeling unit 30 may also include a transition channel extending between the third expansion chamber 34 and a fourth expansion chamber 39, the latter ending in the exhaust aperture 40 of the cleaning apparatus 1. Also the transition channel determines a compression of the fluid passing from the third to the fourth expansion chamber.

Figure 4B:
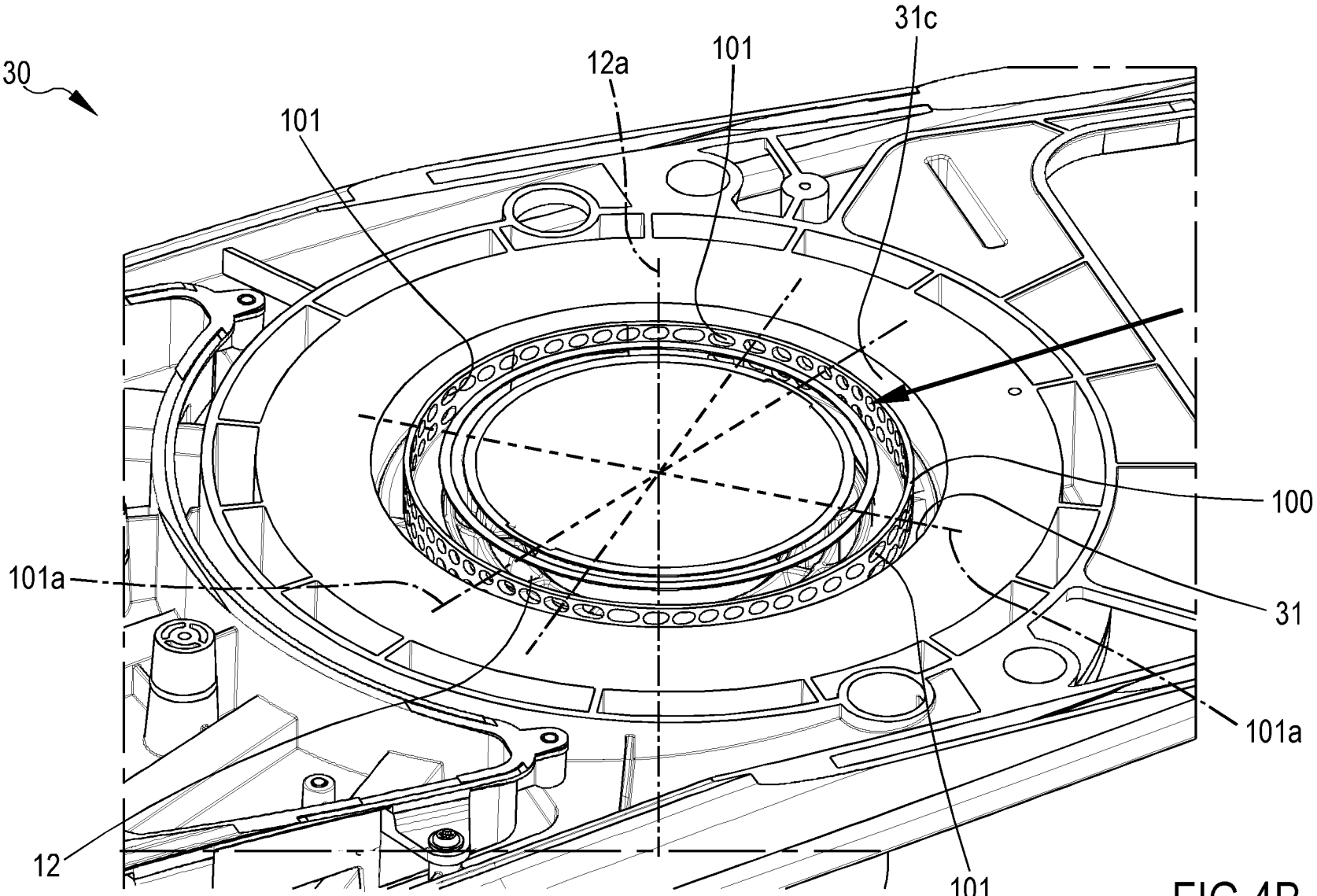
FIG. 4B is an interrupted perspective view of an embodiment of a part of the air outlet channeling unit related to a first expansion chamber of the air coming from the suction unit.

As it may be seen from FIGS. 4A and 4B the first expansion chamber 31 is directed towards the outlet side of the fan or impeller 12 and extends by 360° around the periphery of the fan or impeller 12 defining an annular flow volume entirely surrounding the fan or impeller 12 itself.

According to an aspect of the present disclosure which may or may not be combined with the other aspects here described, at least an intercepting wall 100 comprising a plurality of through holes 101 operates inside the first expansion chamber 31 and is positioned so as to intercept the air flow moving from the outlet side of the fan or impeller 12 toward the outlet port 31*a* of the first expansion chamber 31. The intercepting wall 100 has an annular shape which also extends by 360° around the impeller and is inserted into the annular flow volume of the first expansion chamber 31. For example, as FIGS. 4A and 4B show, the first expansion chamber 31 extends radially between the outlet side of the fan or impeller 12 and an outer peripheral wall 31*c* surrounding the fan or impeller 12 and positioned at a radial distance from the outlet side of the fan or impeller itself: in turn, the intercepting wall 100 is radially positioned between the outlet side of the fan 12 and the outer peripheral wall 31*c* of the first expansion chamber 31, for example, in the above mentioned figures the intercepting wall 100 is positioned in a substantially central position between the outlet side of the fan or impeller and the outer peripheral wall 31*c*.

Going into further detail, the first expansion chamber 31 and the intercepting wall may be positioned concentrically with respect to the fan or impeller 12 and extend all the way around the periphery of the fan itself: furthermore, the annular flow volume delimited by the first expansion chamber 31 has a constant radial width.

Returning to the structure of the intercepting wall 100, the through holes 101 of the same wall may have axial symmetry, optionally cylindrical configuration. In a variant of FIG. 4A the through holes 101 have their axes of symmetry 101*a* parallel to each other: this facilitates the formation of the holes themselves with 2 translating molding tools. Alternatively (as shown in FIG. 4B) the through holes 101 may have respective axes of symmetry 101*a* converging towards a common axis, optionally converging towards the axis of symmetry 12*a* of the fan or impeller.

Regardless of the specific geometric configuration of the holes 101 above described or in combination therewith, each of the holes 101 has for example a fluid passage area measured perpendicularly to the respective axis of symmetry 101*a*, comprised between 3 $mm^2$ and 180 $mm^2$. In case the through holes 101 have a cross section, measured perpendicularly to the respective axes of symmetry 101*a*, that is circular the diameter of that circular section is preferably comprised between 2 mm and 15 mm.

As it may be seen from the mentioned figures, the through-holes 101 are homogeneously distributed or in correspondence with prefixed angular sectors of the intercepting wall (FIG. 4A) or on the entire circumference of the intercepting wall (FIG. 4B) and positioned all around the periphery of the fan or impeller 12; for example, one or more series of through holes may be provided on the intercepting wall: each series of holes has a plurality of holes 101 with centers positioned on a same plane (for example, in the figures are shown holes with respective centers on two parallel planes); furthermore, each series of through holes includes through holes 101 placed at a same angular distance from each other: in FIG. 4B the holes are positioned all around the periphery of the fan/impeller, whereas in FIG. 4A the through holes 101 are positioned on the intercepting wall 100 at two diametrically opposite sectors of the same intercepting wall 100 (this solution, in combination with the aspect of realizing the holes with axes parallel to each other simplifies the structure of the molds used to realize the intercepting wall 100); in FIG. 4A each hole sector includes a plurality of through holes uniformly distributed and has an angular width of at least 90°, for example of at least 120°.

As an alternative to what has been described, the through holes 101 may be arranged next to each other according to two or more patterns of through holes of different configuration with respect to the one illustrated in the figures, where each pattern of holes (defined by the position of the respective centers) is a flat pattern. For example, the holes may be arranged according to different regular patterns: for example wavy patterns.

According to a further aspect of the present disclosure, which may or may not be combined with the other aspects herein described, the various first, second, third and optionally fourth expansion chambers and the relative channels connecting said chambers have the relative dimensions below indicated, in order to guarantee a sequence of expansions and compressions in the passage of the fluid from the impeller 12 to the exhaust aperture 40.

In more detail, the first expansion chamber 31 defines an annular flow volume (intended as the internal volume of the first chamber interested by the passage of air flow and eventual water particles) that has a transversal air flow cross sectional area, measured perpendicularly to the axis of rotation 12*a* of the fan or impeller 12 (i.e. on an ideal plane perpendicular to the axis 12*a* and crossing the annular volume of the first chamber) having an annular shape and a prefixed maximum area; in reality, when the annular flow volume has a regular tubular shape, the area of the transversal air flow cross sectional area is constant. In turn, the first compression channel or orifice 33 has a transversal air flow cross sectional area, measured perpendicularly to the axis of rotation 12*a* of the fan or impeller 12 (i.e., on an ideal plane perpendicular to the axis 12*a*) having a predetermined minimum area which is smaller than the maximum passage area of the transversal air flow cross sectional area of the annular flow volume of the first expansion chamber 31, so that in the passage from the first expansion chamber 31 to the first compression channel 33 there is a significant air compression; for example, the first compression channel or orifice 33 has a transversal air flow cross sectional area having said predetermined minimum area which is at least 1.5 times smaller, more optionally at least 5 times smaller than said maximum area of the transversal air flow cross sectional area of the annular flow volume of the first expansion chamber 31. In a particularly effective solution, the first compression channel orifice 33 has a transversal air flow cross sectional area having said predetermined minimum area which is between 5 and 10 times smaller than said maximum area of the transversal air flow cross sectional area of the annular flow volume of the first expansion chamber 31.

Figure 5:
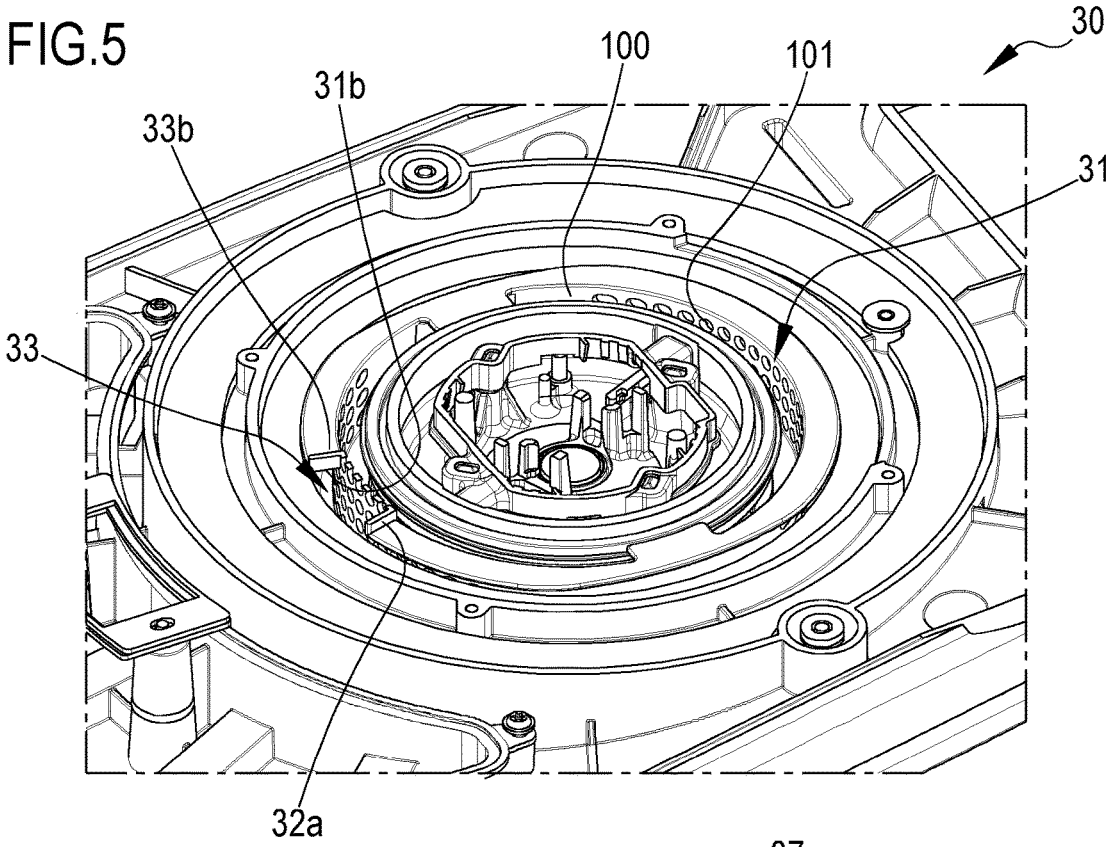
FIG. 5 is an interrupted perspective view of a part of the air outlet channeling unit related to a first compression channel or orifice positioned between the first air expansion chamber and a second air expansion chamber.
Figure 6:
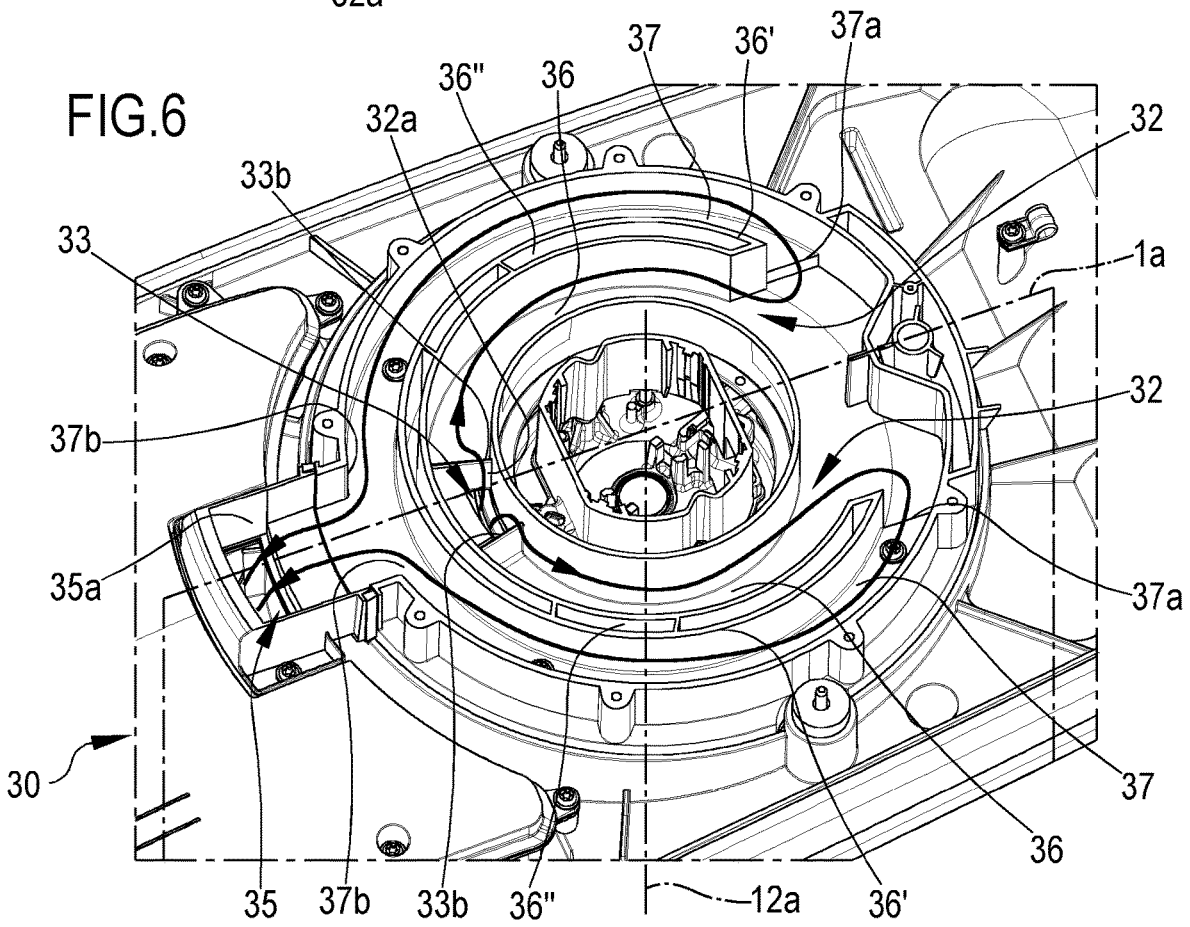
FIG. 6 is an interrupted perspective view of a part of the air outlet channeling unit related to a second air expansion chamber positioned downstream of the first compression channel or orifice referred to in FIG. 5.

As it may be seen in FIGS. 5 and 6 the first compression channel or orifice 33 extends in a non-radial direction, optionally parallel to the axis of rotation 12*a* from an outlet 31*b* of the first expansion chamber 31 towards an inlet 32*a* of the second expansion chamber 32, which, in the illustrated example is positioned above the first chamber 31, substantially overlapping with respect to the first expansion chamber 31 itself, so as to confer to the outlet channeling unit 30 a considerable compactness.

Also the second expansion chamber 32 has a substantially annular flow volume, concentric with said axis of rotation 12*a*, for collecting air deriving from a downstream end 33*b* of the first compression channel or orifice 33 and conveying the collected air towards an outlet port 32*b* of the second expansion chamber 32 opposite to the downstream end 33*b* of the first compression channel or orifice 33.

The annular flow volume of the second expansion chamber 32 includes two semi-annular branches 36 (which in the example of FIG. 6 have an angular travel of about 130°-150° about the axis 12*a*) symmetrically opposite with respect to an ideal plane of symmetry 1*a* of the expansion chamber itself, said plane 1*a* containing the axis of rotation 12*a* of the fan or impeller 12; each semi-annular branch 36 connects the downstream end 33*b* of the first compression channel or orifice 33 to the outlet port 32*b* of the second expansion chamber 32: practically, the outlet port defines a collection area towards which the two opposite semi-annular branches 36 converge.

It is to be noted that the first compression channel or orifice 33 has said air flow cross sectional area (measured perpendicularly to the axis of rotation 12*a*) having said predetermined minimum area which is significantly smaller than the sum of the maximum areas of the transversal air flow cross sectional areas of the two semi-annular branches 36 of the second expansion chamber 32 (the transversal air flow cross sectional areas of the two branches 36 are measured on an ideal plane radially crossing said semi-annular branches 36 and containing the axis of rotation 12*a*). For example, the transversal air flow cross sectional area of the first channel or orifice 33 has said predetermined minimum area which is at least 1.5 times smaller, optionally at least 5 times smaller than the sum of the maximum areas of the transversal air flow cross sectional area of the two semi-annular branches 36. In a particularly effective solution, the transversal air flow cross sectional area of the first channel or orifice 33 has said predetermined minimum area which is between 5 and 10 times smaller than the sum of the maximum areas of the transversal air flow cross sectional areas of the two semi-annular branches 36.

As it may be seen in FIG. 6, the outlet channeling unit 30 may also include two peripheral channels 37: each of the two peripheral channels 37 surrounds a respective portion of the second expansion chamber 32 and has an inlet end 37*a*, at the outlet port 32*b* of said second expansion chamber 32, and an outlet end 37*b*, opposite to the inlet end 37*a*, connected to an upstream end 35*a* of the second compression channel or orifice 35. Practically, the peripheral channels 37 surround the semi-annular branches 36 and converge in a conjunction area before entering the second compression channel or orifice 35. In greater detail, the two peripheral channels 37 form respective semi-annular fluid volumes: each peripheral channel and relative semi-annular fluid volume is adjacent to a respective semi-annular branch 36 of the second expansion chamber 32: the two peripheral channels 37 have outlet ends 37*b* joining at the upstream end 35*a* of the second compression channel or orifice 35. According to an optional variant, the volume of semi-annular fluid of each peripheral channel 37 has a transversal air flow cross sectional area, measured on said ideal plane radially crossing said semi-annular branches 36 and comprising the axis of rotation 12*a*, of maximum area substantially equal to, or differing for no more than 20% with respect to, the maximum area of the transversal air flow cross sectional area of the respective adjacent semi-annular branch 36 of the second expansion chamber 32 measured as above indicated with reference to the semi-annular branches 36.

The second compression channel or orifice 35 also has a transversal air flow cross sectional area, measured perpendicularly to a further ideal plane radially crossing the second compression channel or orifice 35 and containing the axis of rotation of the impeller (practically, in the illustrated examples, said further ideal plane corresponds with the vertical plane of symmetry of the second compression channel or orifice), having a predetermined minimum area which is smaller than the sum of the maximum areas of the transversal air flow cross sectional areas, measured on said ideal plane radially crossing the semi-annular branches 36 and containing the axis of rotation 12*a*, of the two semi-annular branches of the second expansion chamber 32. In detail, the air flow cross sectional area of the second compression channel or compression orifice 35 may have said predetermined minimum area which is at least 1.5 times smaller, or at least 2 times smaller, or even at least 5 times smaller, than the sum of the maximum areas of the transversal air flow cross sectional areas of the two semi-annular branches 36 of the second expansion chamber 32.

Figure 7:
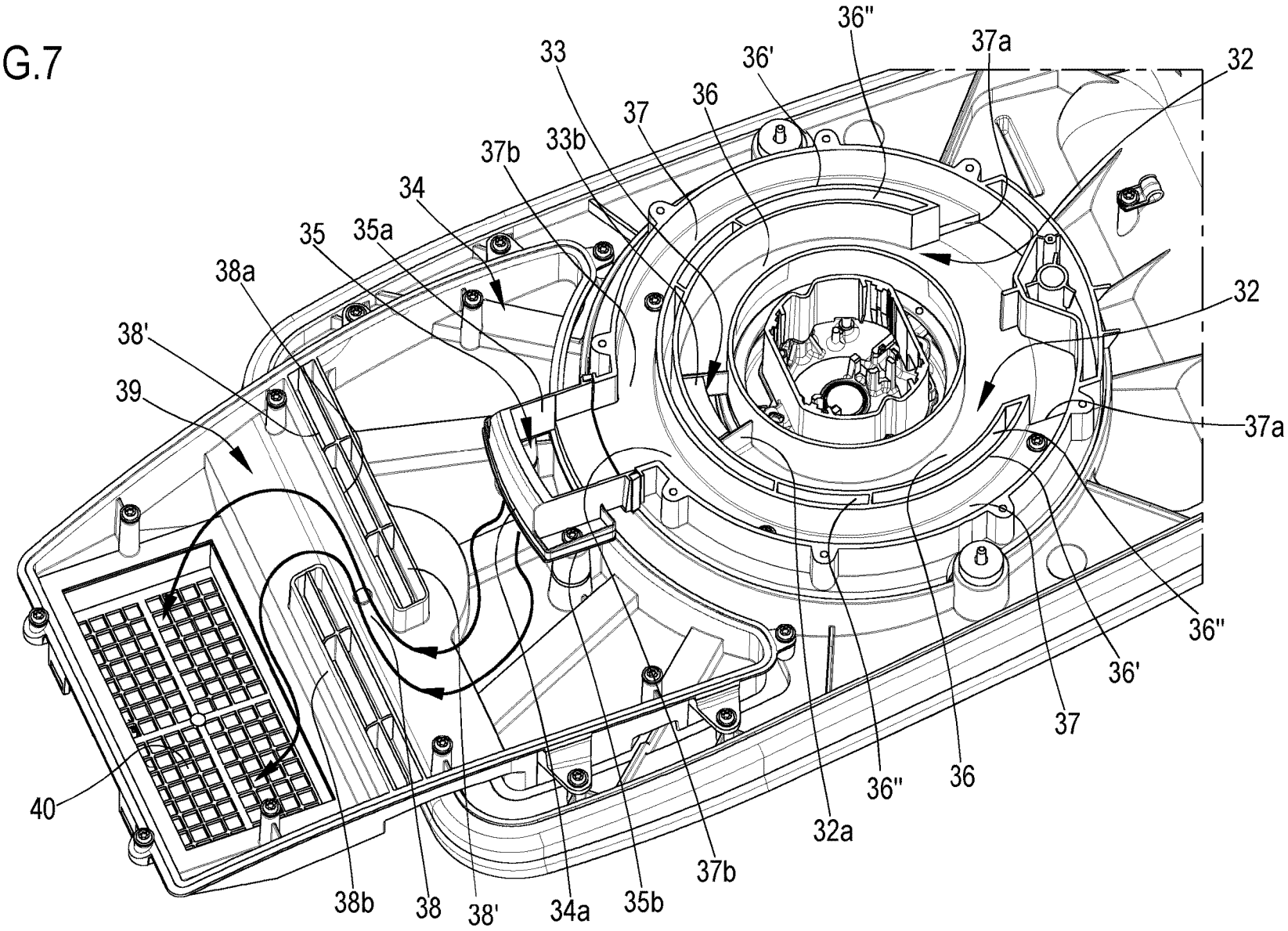
FIG. 7 is an interrupted perspective view of a part of the air outlet channeling unit showing the second air expansion chamber, two peripheral channels placed around and downstream of the second expansion chamber, a second air compression channel or orifice downstream of the two peripheral channels, a third air expansion chamber downstream of the second air compression channel or orifice, an outlet transition channel from the third expansion chamber, and a fourth and last expansion chamber which brings to one or more spent air exhaust apertures to the outside.

According to a further aspect which may or may not be combined with the aspects described herein, the first compression channel or orifice 33 and the second compression channel or orifice 35 are positioned on the same side of the outlet channeling unit 30, with the second compression channel or orifice 35 positioned at least partially above the first compression channel or orifice 33 (see FIG. 7). Again with reference to FIG. 7, it may be seen that in the illustrated example, the second compression channel or orifice 35 extends, at least partially, radially away from the axis of rotation 12*a* of the fan or impeller: in detail, the second channel or orifice 35 has a downstream end 35*b* which joins to an inlet 34*a* of the third expansion chamber 34.

The third expansion chamber 34 extends radially away from the axis of rotation 12*a* opposite to the outlet port 32*b* of the second expansion chamber 32 and has a transversal air flow cross sectional area measured perpendicular to said further ideal plane (above defined) having a prefixed maximum area greater than the minimum transversal air flow cross sectional area of the second compression channel or orifice 35 measured perpendicular to the same further ideal plane. For example, the third expansion chamber 34 has a transversal air flow cross sectional area measured perpendicular to said further ideal plane (above defined) having a prefixed maximum area which is at least 1.5 times greater than, for example at least 5 times greater than the minimum area of the transversal air flow cross sectional area of the second compression channel or orifice 35 measured perpendicular to the same further ideal plane. This leads to an effective expansion in the passage to the third chamber. In an effective solution, the third expansion chamber 34 has a transversal air flow cross sectional area, measured perpendicular to said further ideal plane (above defined) having a prefixed maximum area which is between 5 and 10 times greater than the minimum area of the transversal air flow cross sectional area of the second compression channel or orifice 35 measured perpendicular to the same further ideal plane.

As already mentioned, the outlet channeling unit 30 may also include (FIG. 7) the transition channel 38 which connects the third expansion chamber 34 with the fourth expansion chamber 39, the latter ending in the exhaust aperture 40; the fourth expansion chamber 39 has a transversal air flow cross sectional area, measured perpendicular to said further ideal plane (above defined), with a prefixed maximum area which is greater than the minimum area of the transversal air flow cross sectional area of the transition channel 38 the latter measured parallel to the same further ideal plane. For example, the fourth expansion chamber 39 has a transversal air flow cross sectional area, measured perpendicular to said further ideal plane (above defined) whose prefixed maximum area is at least 1.5 times greater than, for example at least 5 times greater than the minimum area of the transversal air flow cross sectional area of the transition channel 38 measured parallel to the same further ideal plane. In an effective solution, the fourth expansion chamber 39 has a transversal air flow cross sectional area, measured perpendicular to said further ideal plane (above defined) having a prefixed maximum area which is between 5 and 10 times greater than the minimum area of the transversal air flow cross sectional area of the transition channel 38 measured parallel to the same further ideal plane.

As it may be seen in FIG. 7, the transition channel 38 may optionally define an air flow path having chamber 34: in this case, the air flow from the third expansion chamber 34 to the fourth expansion chamber 39 changes direction at least twice before reaching the exhaust aperture.

According to a further aspect, the transition channel 38 includes at least a deflector 38*a*, optionally at least two deflectors 38*a*, 38*b* spaced and offset between them. The deflector or deflectors is/are positioned transversely to the ideal second plane so that there is no straight line (ideal) passing through the exhaust aperture 40 which passes through the outlet of the second compression channel or orifice 35 without impacting on said at least one deflector, optionally on both said deflectors. Evidently this further contributes to noise reduction.

It is to be noted that, according to another aspect, that the various parts of the outlet channeling unit 30 are shaped and positioned so that there is no straight line (ideal) passing through the outlet port 32*b* of the second expansion chamber 32 and that crosses the first compression channel or orifice 33, without impacting on at least one other component of the outlet channeling unit 30. Similarly, there is no straight line passing through the outlet port 32*b* of the second expansion chamber 32 and that crosses the second compression channel or orifice 35, without impacting on at least one other component of the outlet channeling unit 30. Also these other aspects contribute to noise reduction.

According to a further aspect, one or more of the walls forming the outlet channeling unit are hollow and include insulation cavities within each wall and containing air or sound-absorbing material. For example each of the two peripheral channels 37 above described is separated from the respective adjacent semi-annular branch 36 by a hollow separation septum 36'. The hollow separation septum 36' is radially delimited by a radially internal wall and a radially external wall which are radially spaced from one another to define one or more inner insulation cavities 36": each of said insulation cavities 36" of the hollow separation septum is filled with air or sound-absorbing material. It is to be noted that each insulation cavity 36" of the hollow separation septum 36' is for example gas-tightly insulated from an environment external to the hollow separation septum itself. In the illustrated examples also the at least a deflector 38*a* is a hollow body including one or more insulation internal cavities 38'; optionally each of the at least two deflectors 38*a*, 38*b* is a hollow body including one or more internal insulation cavities: also in this case each of insulation cavity of each deflector is filled with air or sound-absorbing material and may be gas-tightly insulated from an environment external to the deflector itself. Even if in the illustrated examples only some of the walls defining the outlet channeling unit 30 are equipped with internal soundproofing cavities, it is of course also possible to realize further walls in this way of the unit 30.

According to another aspect combinable with or independent from the other aspects herein described, the walls delimiting the first expansion chamber 31, the walls delimiting the second expansion chamber 32, the walls delimiting the third expansion chamber 34 and optionally the walls delimiting the fourth expansion chamber 39 do not include any alveolar material such as foam or other foam material applied to the walls themselves (i.e. in potential contact with the air flow): this aspect prevents the alveolar material from becoming impregnated with liquid particles eventually present in the air flow crossing the outlet channeling unit (which may happen when the apparatus 1 is configured to sprinkle water, detergent or disinfectant liquids, concentrates, and more from the dispensing channels 77). In an effective form of this aspect the entire outlet channeling unit 30 and the entire inlet channeling unit 20 do not include any alveolar material, optionally do not include any foam material that may be in contact with the treated air/fluid flow.

Figure 2:
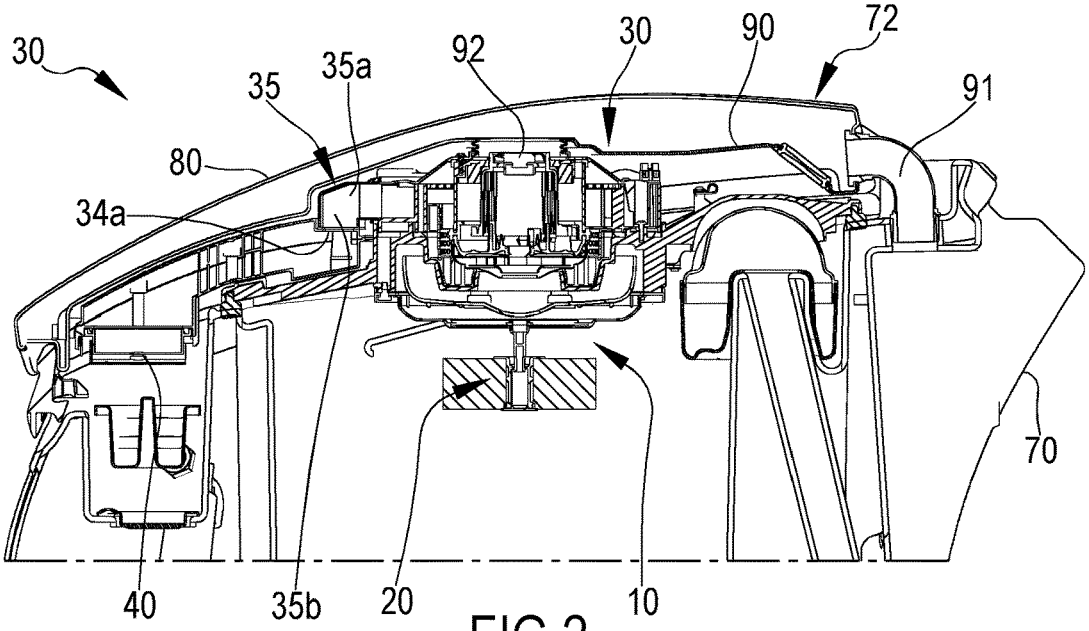
FIG. 2 is a longitudinal sectional view, rotated by 180° and enlarged with respect to FIG. 1, of an upper portion of the apparatus of FIG. 1.

According to another aspect combinable with or independent from the other aspects here described, the floor cleaning apparatus 1 includes a motor cooling circuit 90 that in turn includes: a fresh air inlet conduit 91, a fan 92 operative on a side of the motor 11 opposite to that of the impeller or fan 12 and positioned to receive air coming from the fresh air inlet conduit 91, a spent air discharge path 93 passing at least around a portion of a body of the motor 11. In an embodiment shown in the attached FIGS. 1 and 2, the motor cooling circuit 90 is for example contained in the cover structure 80 and is kept separate from the inlet channeling unit 20, from the outlet channeling unit 30 and from the fan or impeller 12, so that, on one hand, the motor is efficiently cooled and, on the other hand, the motor 11 is never hit by liquid particles that could compromise its operation, since the motor 11 is generally of the electric type. In the example illustrated in FIGS. 1 and 2 there is no fluid communication inside the cover structure 80, between the motor cooling circuit 90 on the one side, and the inlet channeling unit 20, the outlet channeling unit 30 and the fan or impeller 12 on the other side.

According to another aspect combinable with or independent from the other aspects here described, the cleaning unit 50 of the assembly 500 is mounted on the chassis 138 with at least one degree of freedom relative to the chassis itself in order to allow the cleaning unit 50 to be lifted and lowered with respect to the chassis 138. As it may be seen in the example of FIGS. 8 and 9, the apparatus 1 includes one suspension device 139 operatively active on the cleaning unit 50 and interposed between it and the chassis 138: the device 139 is configured to transmit to the cleaning unit 50 an upwardly directed force, so as to compensate for a part of the weight of the cleaning unit that would otherwise be borne entirely by one or more cleaning elements, such as discs or cleaner rollers carried by the unit 50 itself and active in contact with the floor to be cleaned.

In an example that proved effective, the suspension device 139 (which may include a single device or two devices each one on a respective side of the two opposite sides of the apparatus) is configured for generally transmitting to the cleaning unit 50 an upwardly directed force not greater than the cleaning unit weight, i.e. below 0.75 of the cleaning unit weight, optionally in a range between 0.45 and 0.55 of the cleaning unit weight.

Figure 8:
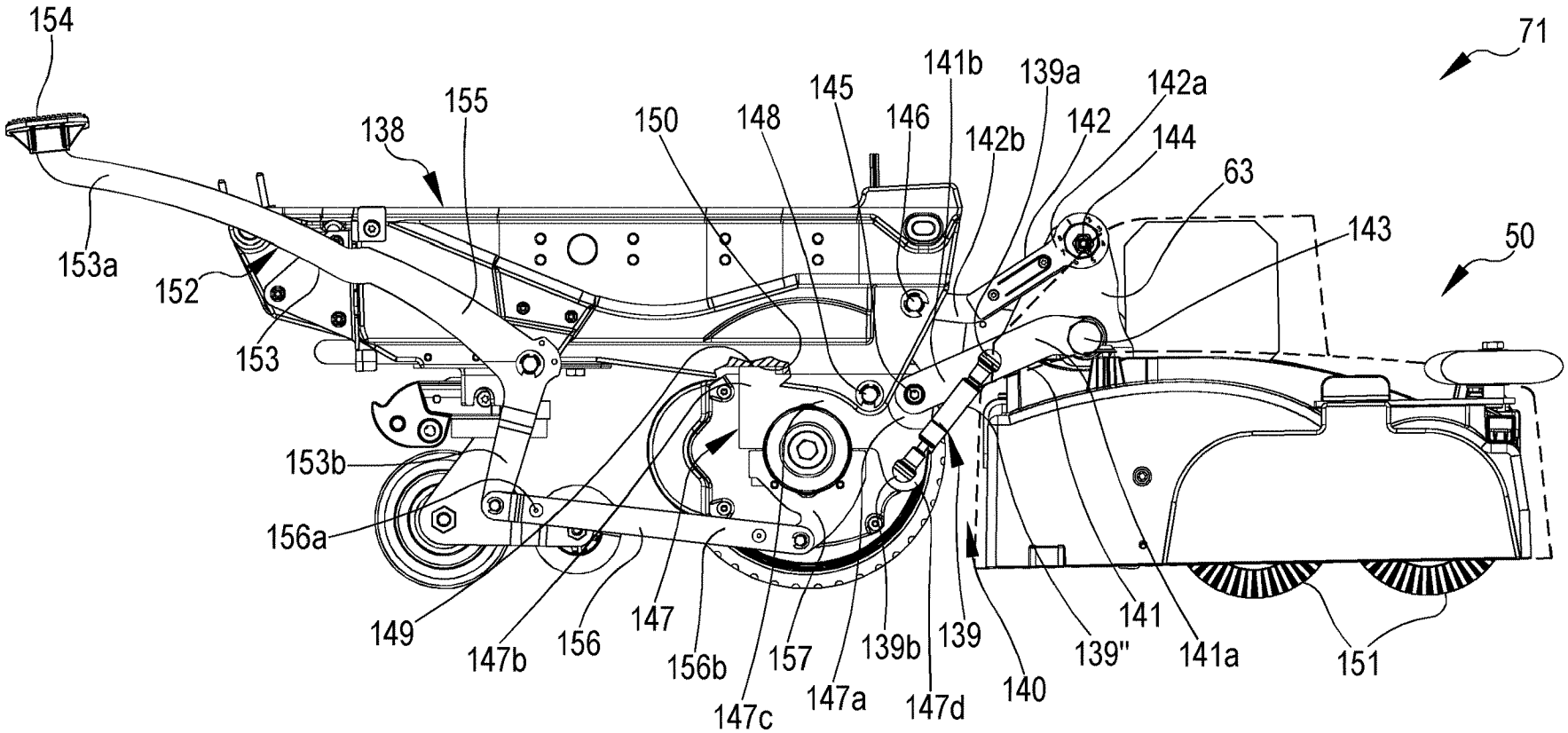
FIG. 8 is a lateral view of a lower portion of an apparatus according to aspects of the invention provided with a roller cleaning unit, wherein the cleaning unit is in an operative working condition.
Figure 9:
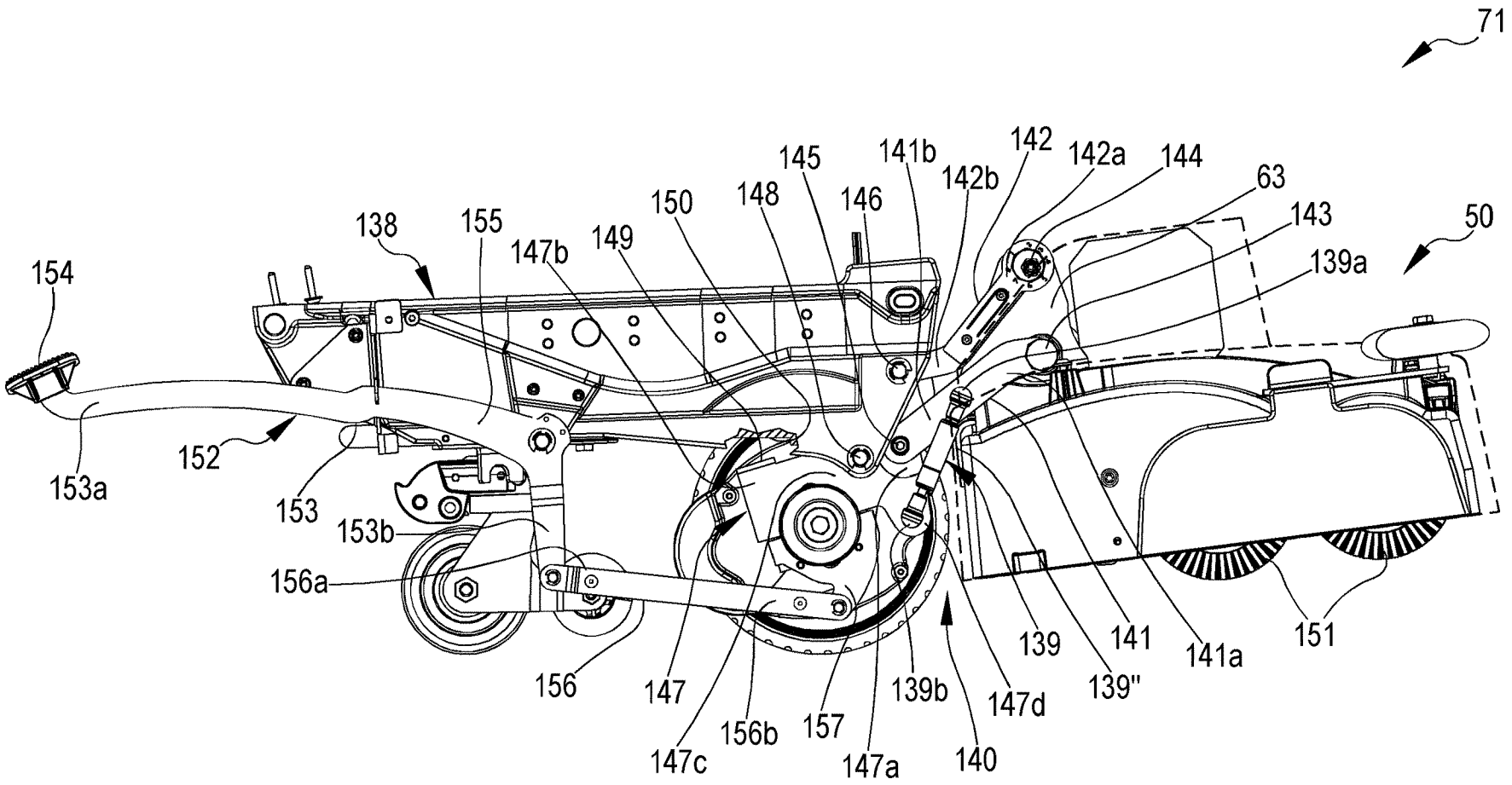
FIG. 9 is a lateral view of a lower portion of the apparatus of FIG. 8 wherein the cleaning unit is lifted from the floor in a rest condition.
Figure 10:
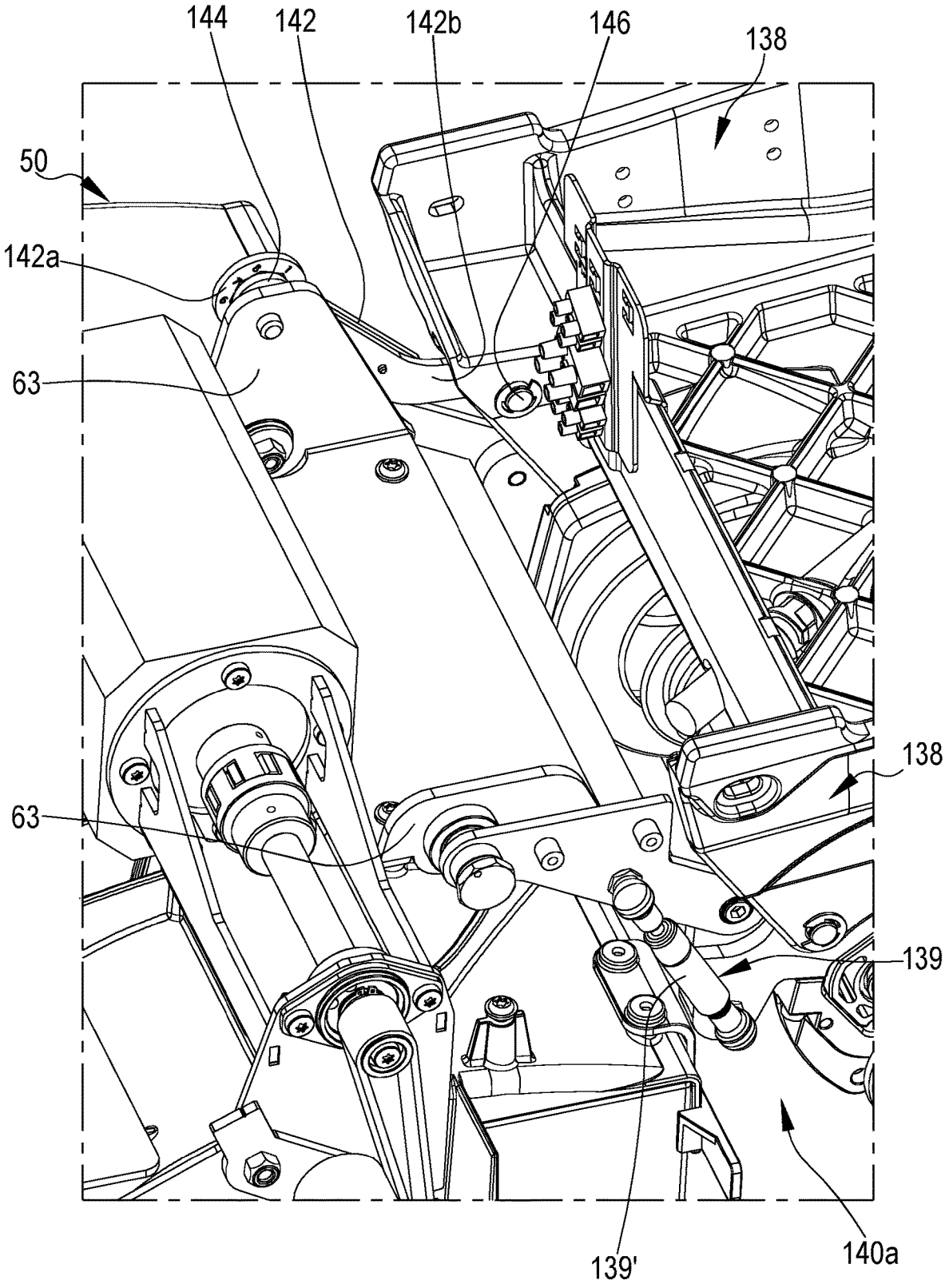
FIG. 10 is an interrupted perspective view of a detail relating to a mechanism connecting a front end of the chassis of a cleaning apparatus according to aspects of the invention to a support framework of the cleaning unit.
Figure 11:
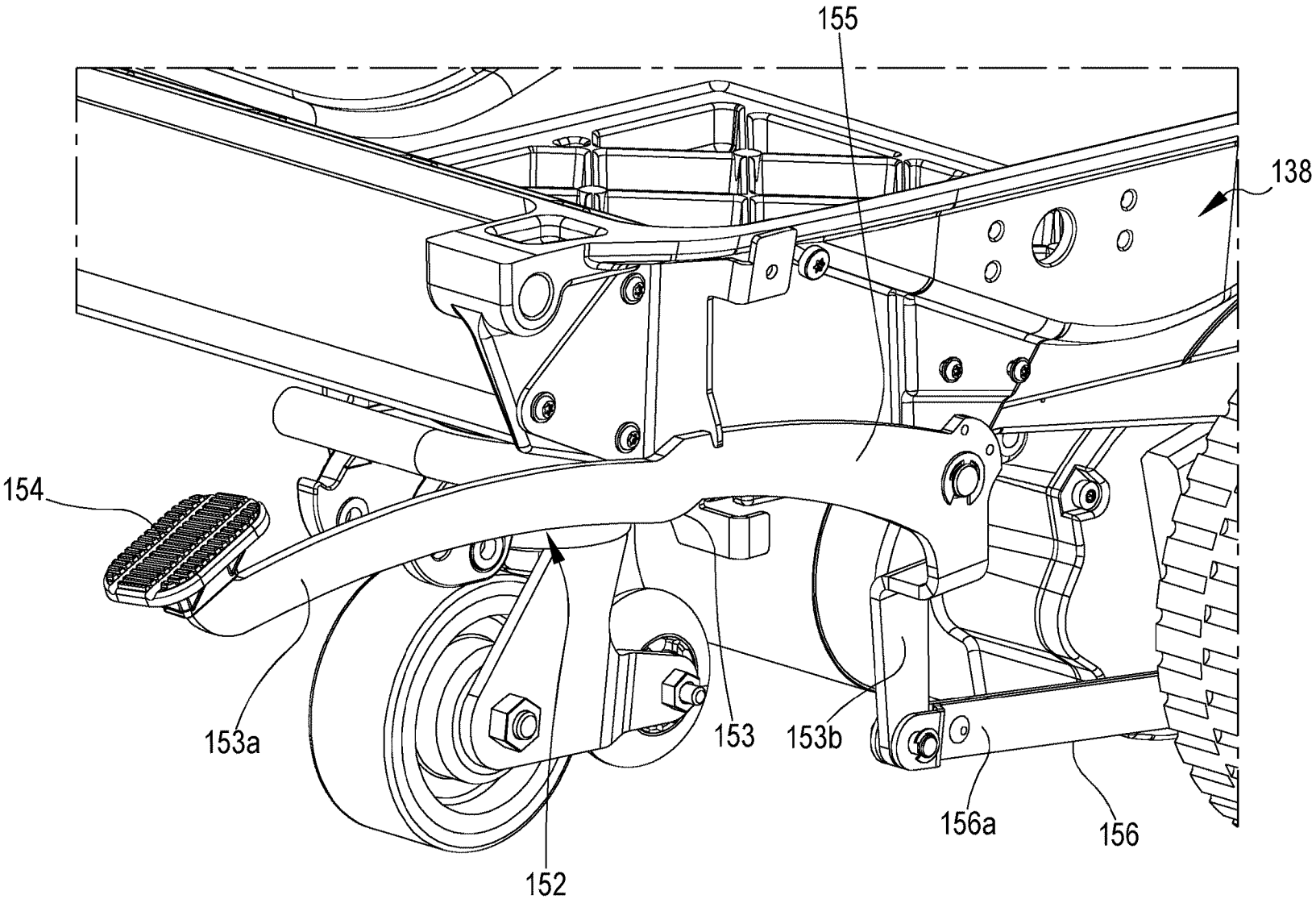
FIG. 11 is an interrupted perspective view of a pedal actuated leverage active on said mechanism of FIG. 10.
Figure 12:
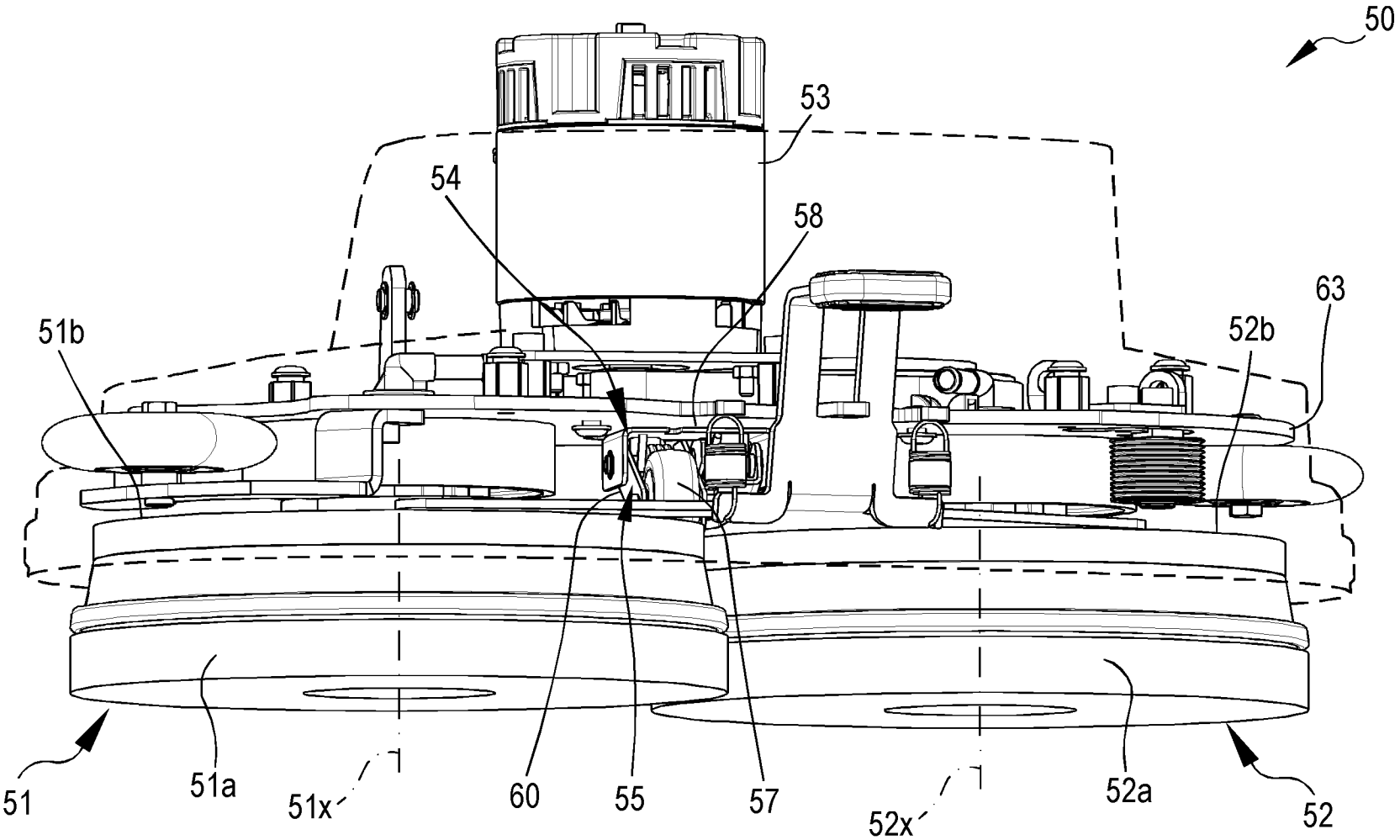
FIG. 12 shows an interrupted perspective view of a cleaning unit having sided cleaning discs of a floor cleaning apparatus according to further aspects of the invention.
Figure 13:
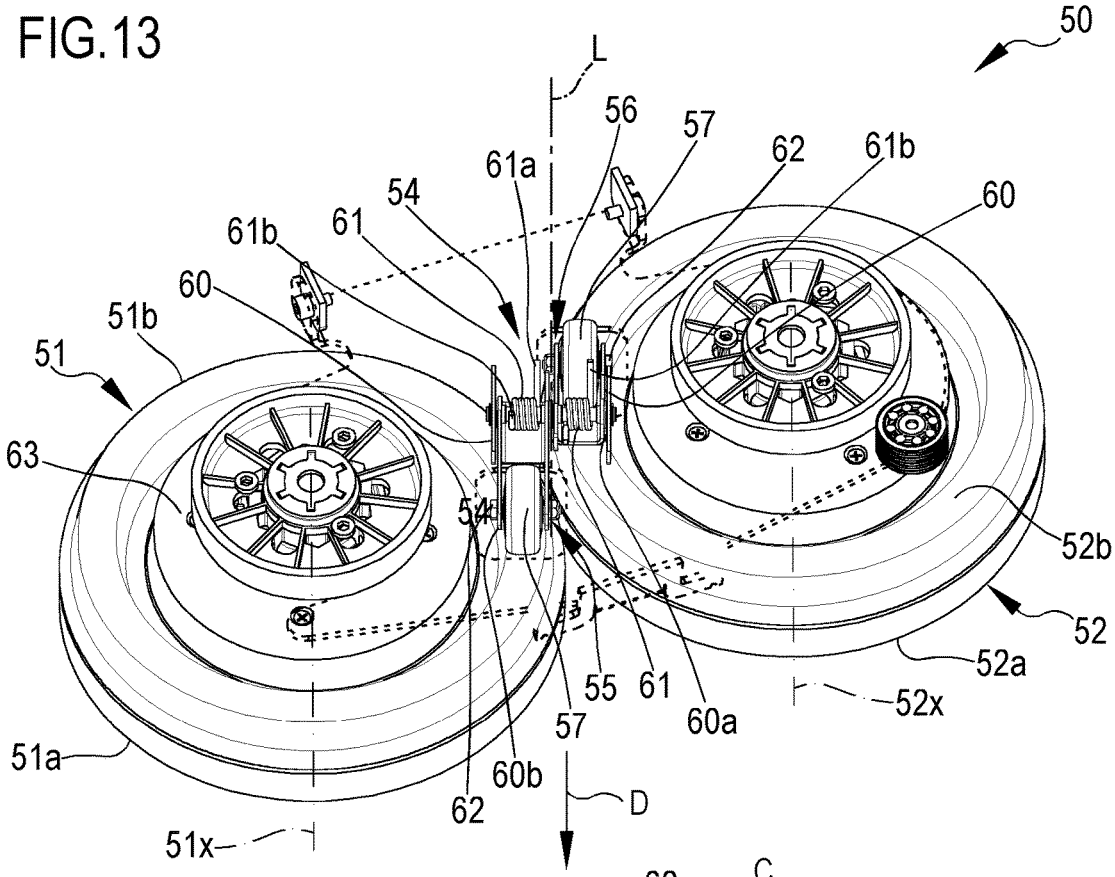
FIG. 13 shows in a perspective view from above, the detail of the cleaning unit of FIG. 12 relating to cleaning discs and the presser device associated thereto according to aspects of the invention.
Figure 14:
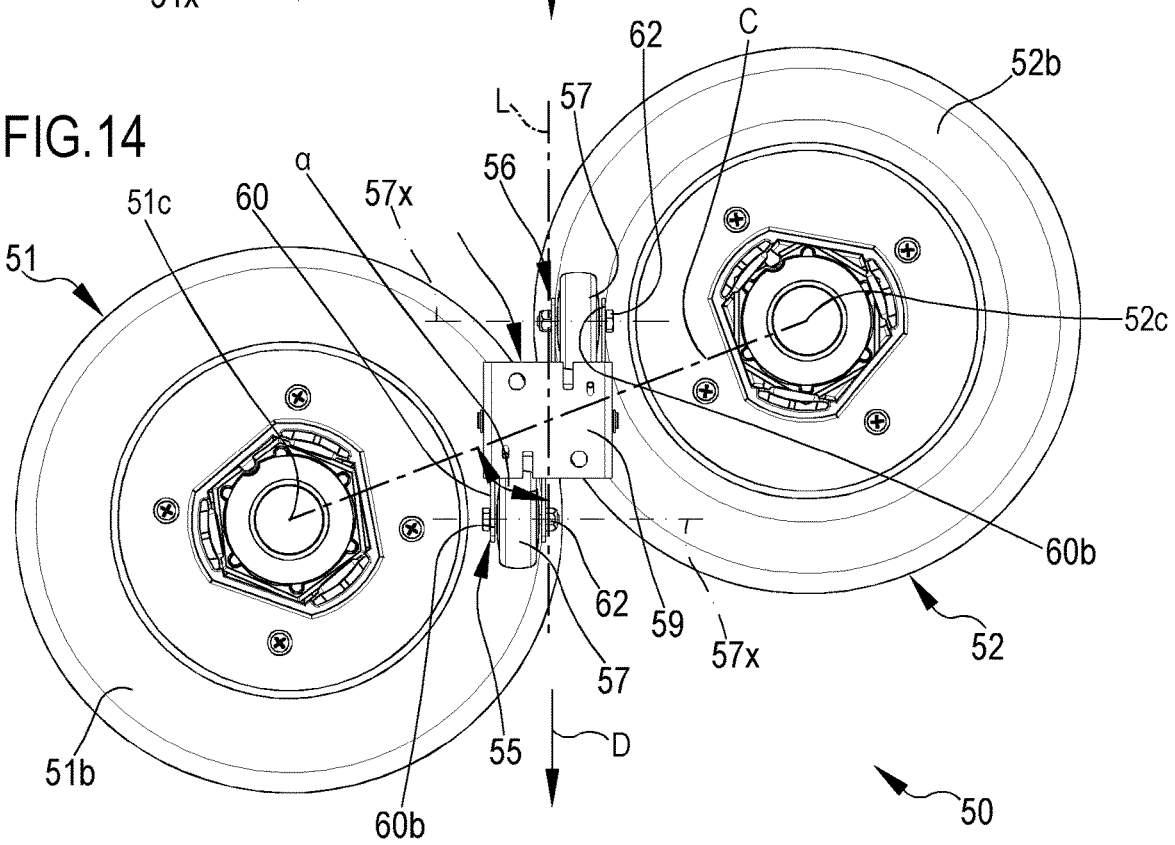
FIG. 14 is a plan view of the cleaning discs and of the presser device of FIG. 13.
Figure 15:
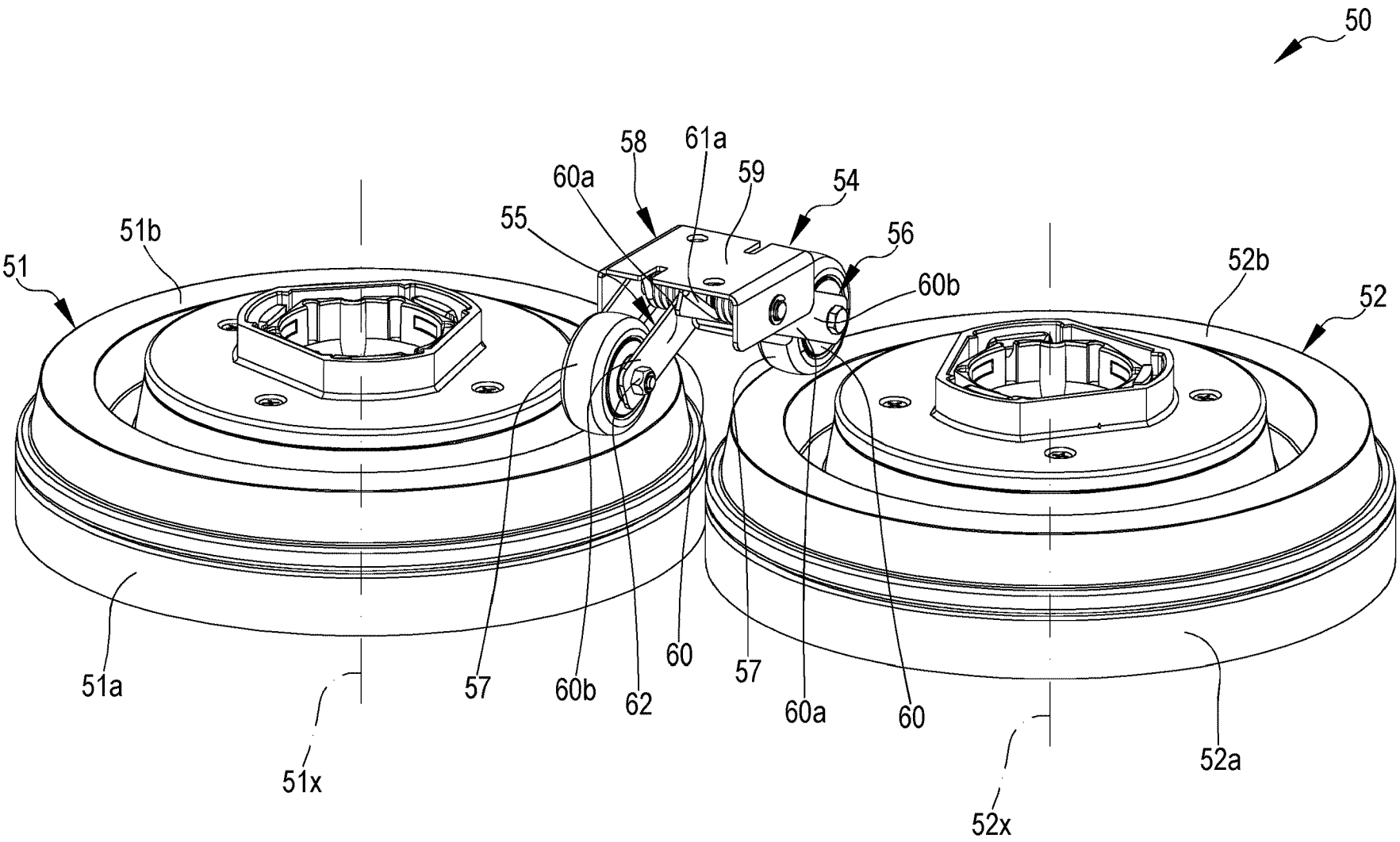
FIG. 15 shows, in perspective view enlarged with respect to FIG. 13, the same cleaning discs and presser device of FIG. 13.
Figure 16:
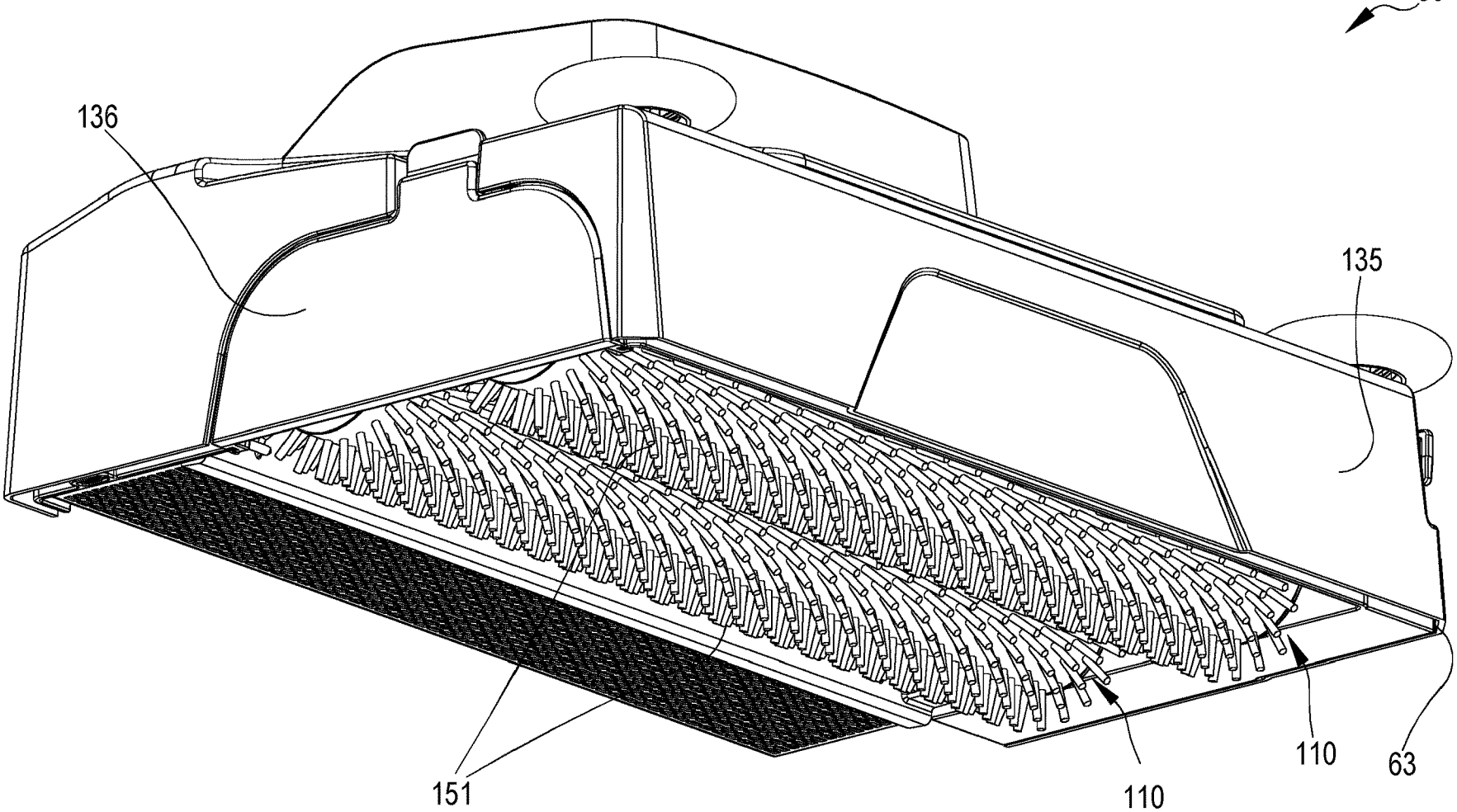
FIG. 16 shows a perspective view from below of a cleaner roller cleaning unit according to further aspects of the invention.
Figure 17:
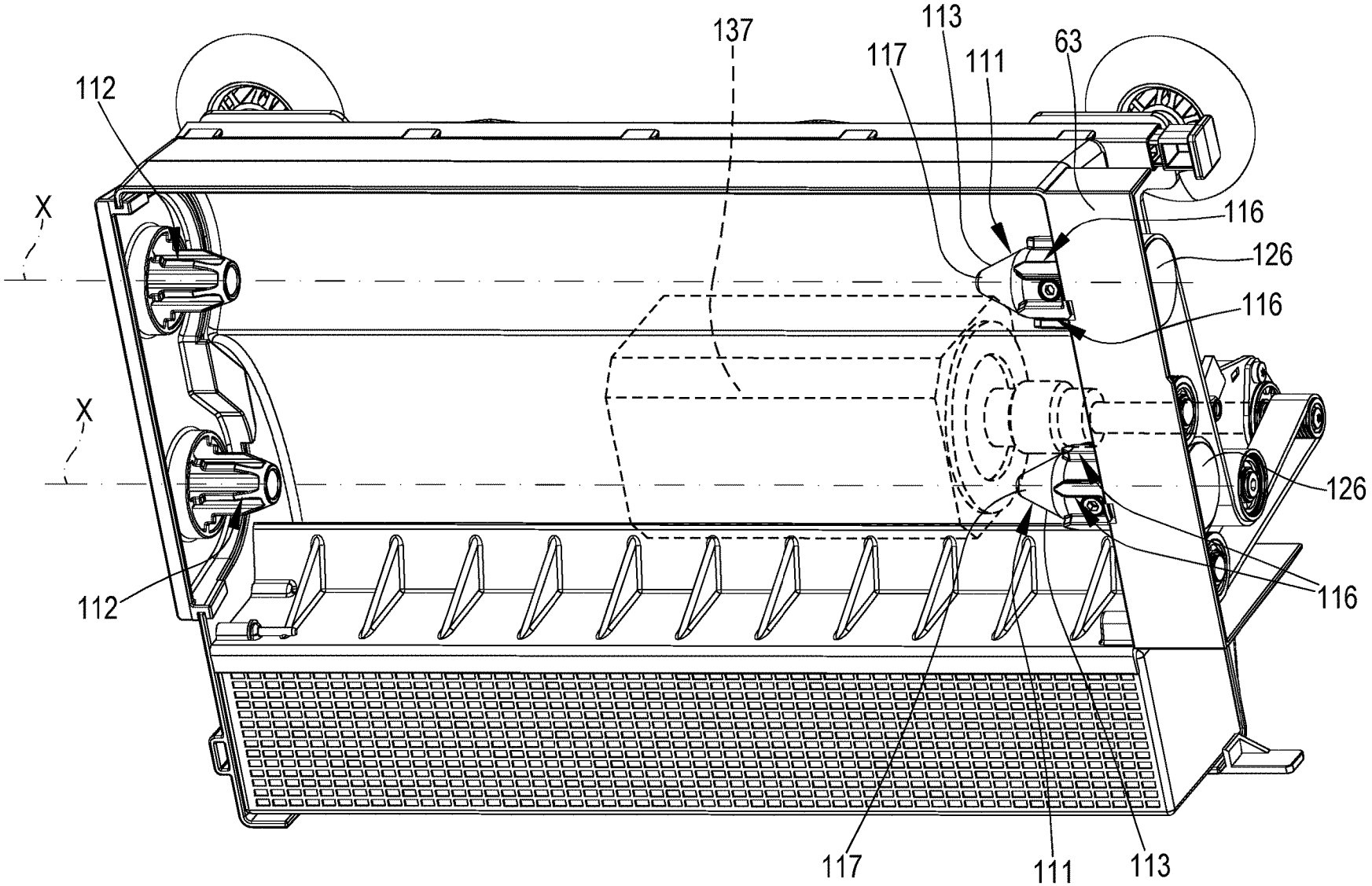
FIG. 17 shows a perspective view of the cleaning unit of FIG. 16 from which the cleaner rollers have been removed.
Figure 18:
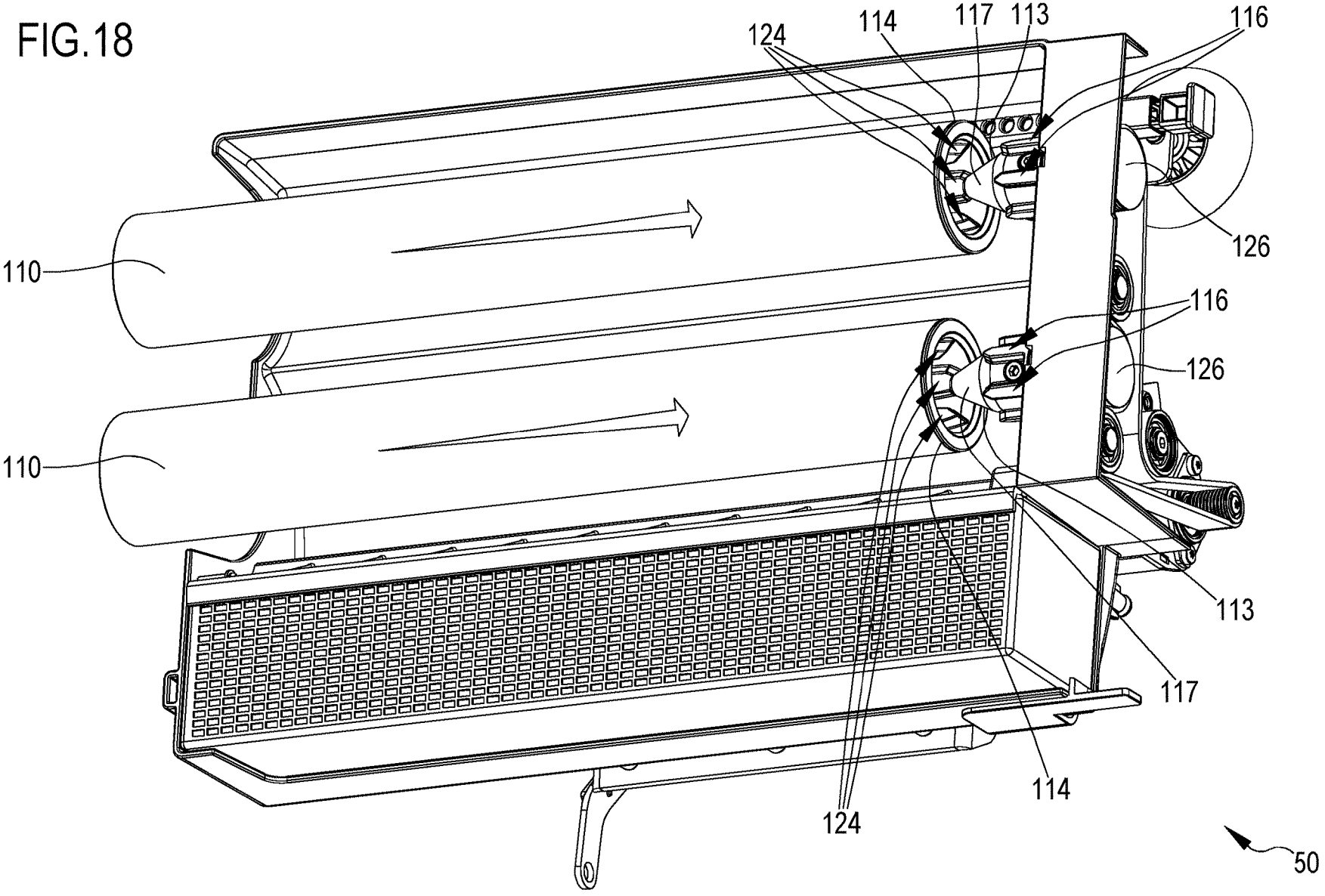
FIG. 18 shows a perspective view of the cleaning unit of FIG. 16 during a coupling phase of the cleaner rollers.
Figure 21:
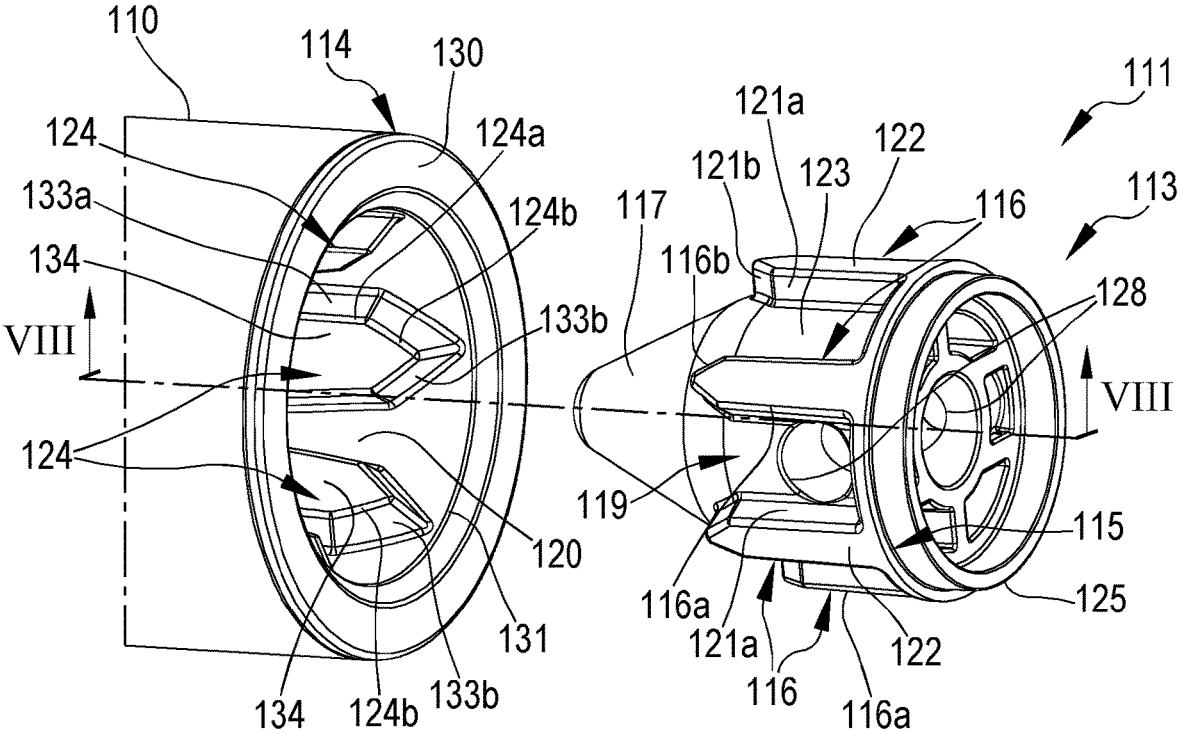
FIG. 21 shows a perspective view of the male component of FIG. 19 juxtaposed with the corresponding female component of the connector interposed between a support framework of the cleaning unit of FIG. 16 and one end of a cleaner roller, to rotatably engage the cleaner roller itself to the support framework, according to further aspects of the invention.
Figure 22:
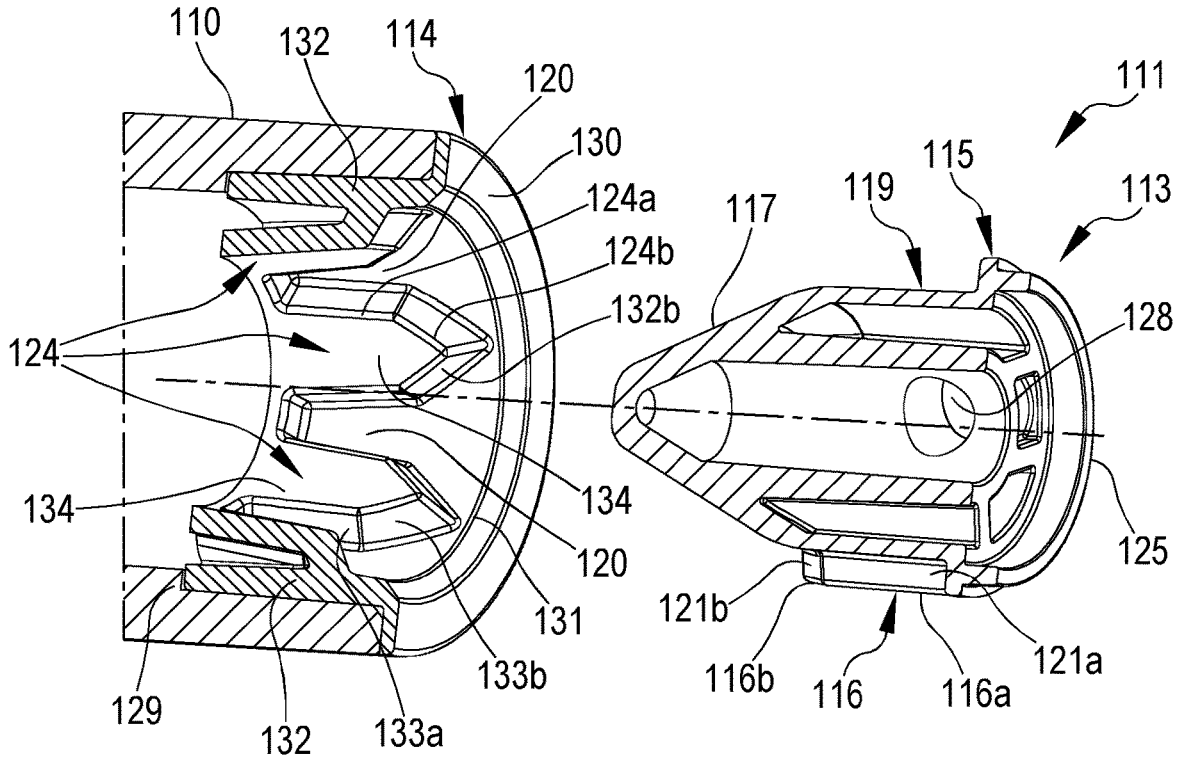
FIG. 22 shows the perspective view of FIG. 21 longitudinally sectioned.
Figure 23:
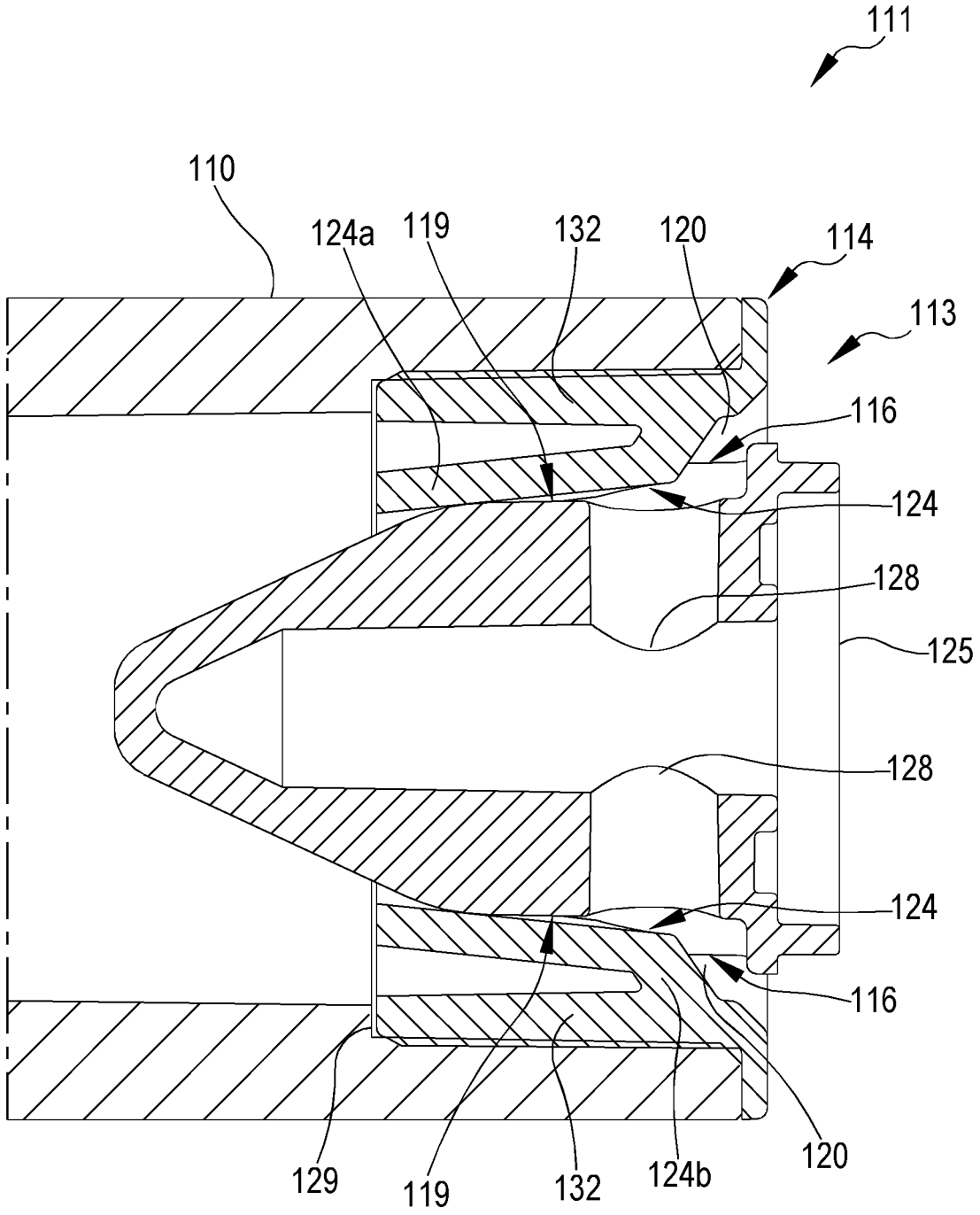
FIG. 23 is a longitudinal section of the male component and of the female component of FIG. 21 coupled together.

The apparatus 1 also includes at least a mechanism 140 that connects a front end of the chassis 138 (for example a lower and front area of the chassis 138) with a support framework 63 of the cleaning unit 50. The mechanism makes the cleaning unit 50 integral with the chassis 138 in the movement along the work path of the apparatus 1, but allows at the same time a relative upward (and downward) movement of the support framework 63 and then of the cleaning unit 50 with respect to the chassis 138. The mechanism 140 includes a first lever 141 having a first end 141*a* coupled with the support framework 63 of the cleaning unit 50 and a second end 141*b*, opposite with respect to the first end 141*a*, cinematically connected with the chassis 138. The mechanism 140 includes also a second lever 142 having a first end 142*a* coupled with the support framework 63 of the cleaning unit 50 and a second end 142*b*, opposite to the first end 142*a*, cinematically connected with the chassis 138. In the example of FIGS. 8 and 9 the second lever extends above the first lever forming a kind of articulated parallelogram. Going into further detail the first end 141*a* of the first lever 141 is rotatably coupled to the support framework 63 of the cleaning unit 50 at a first coupling or joint point 143, whereas the first end 142*a* of the second lever 142 is rotatably coupled to the support framework 63 of the cleaning unit 50 at a second coupling or joint point 144: the first coupling point 143 is spaced from the second coupling point 144 and is optionally positioned below the second coupling point 144 itself, as it may be seen in FIGS. 8 and 9. The second end 141*b* of the first lever 141 is in turn rotatably coupled, at a third coupling or joint point 145, directly to the chassis 138 or to an auxiliary support member 147 cinematically connected to the chassis 138 itself; the second end 142*b* of the second lever 142 is rotatably coupled to a fourth coupling or joint point 146 to the chassis 138: the third coupling point 145 is spaced below the fourth coupling point 146.

In the example of FIGS. 8 and 9 the mechanism 140 comprising the already mentioned auxiliary support member 147 is provided: in detail this auxiliary support member has a front portion 147*a*, a rear portion 147*b* and an intermediate portion 147*c* extending between the front portion 147*a* and the rear portion 147*b*; in this example, therefore, the second end 141*b* of the first lever 141 is coupled, optionally rotatably coupled, to the auxiliary support member 147 at the third coupling point 145 that is positioned at the front portion 147*a* of the auxiliary support member 147; it is to be noted that the intermediate portion 147*c* of the auxiliary support member 147 is in turn rotatably coupled to the chassis 138 at a fifth coupling point 148: in the example of FIGS. 8 and 9 the fifth coupling point 148 is spaced and set back from the third coupling point 145. The rear portion 147*b*, finally, carries an abutment 149 intended to cooperate with a corresponding abutment 150 of the chassis 138 to limit an angular stroke of the auxiliary support member 147 with respect to the chassis 138 about the fifth coupling or joint point 148. Practically, thanks to the coupling point 148, the auxiliary support member 147 is angularly movable about the fifth coupling point 148 with respect to the chassis 138 from a first end stroke position, where the abutment 149 on the auxiliary support member 147 touches the abutment 150 on the chassis 138, to a second end stroke position, where the abutment 149 on the auxiliary support member 147 is angularly spaced from the abutment 150 on the chassis 138; at the first end stroke position of the auxiliary support member 147 (FIG. 8), the cleaning unit 50 is in an operative cleaning position with an active portion 151 configured for contacting a floor to be cleaned, whereas, at the second end stroke position of the auxiliary support member 147 (FIG. 9), the cleaning unit 50 is in a rest position lifted with respect to the cleaning position so as to prevent the active portion 151 from coming into contact with the floor to be cleaned. In the illustrated examples, the active portion includes one, two or more cleaner rollers with a horizontal axis of rotation arranged in sequence one after the other and active on the floor.

In another aspect the floor cleaning apparatus 1 includes a pedal actuated leverage 152 active on the auxiliary support member 147 for moving the auxiliary support member 147 between the first end stroke position and the second end stroke position above described. As an alternative to the pedal actuated leverage it may be provided a motorized actuation system or an actuation system with pneumatic or hydraulic actuators or another actuation system. Returning to the example of FIGS. 8 and 9, the pedal actuate leverage 152 includes a pedal actuated lever 153 with a pedal 154 at a first end 153*a* of the lever 153. The pedal actuated lever 153 has then an intermediate portion 155 hinged to a lower portion of the chassis 138, and a second end 153*b*: as it may be seen from the mentioned figures, the lever 153 is for example shaped like an inverted L so that the first end 153*a* is directed upwards and the second end 153*b* is vice versa directed downwards. The pedal actuated leverage 152 includes also a transmission lever 156 having a first end 156*a*, hinged to the second end 153*b* of the pedal lever 153, and a second end 156*b* directly or indirectly active on said auxiliary support member 147; in the example of FIGS. 8 and 9 the second end 156*b* is optionally hinged to a component 157 angularly fixed to the auxiliary support member 147. Practically, a user may press with the foot the pedal 154 and rotate the pedal lever 153 counter clockwise thus causing a forward thrust of the transmission lever 156 which may angularly move the auxiliary support member 147 causing the lifting of the cleaning unit 50.

The apparatus 1 includes as already mentioned at least one suspension device 139 which is interposed between the cleaning unit 50 and the mechanism 140 connecting the front end of the chassis 138 to the support framework 63 of the cleaning unit 50. The suspension device 139 includes one first end 139*a* connected to an intermediate portion 141*b* of the first lever 141 or of the second lever 142 and one opposite second end 139*b* connected to the chassis 138 or the auxiliary support member 147. In detail, the suspension device 139 referred to in the example of FIGS. 8 and 9 includes one first end 139*a* connected (for example rotatably) to an intermediate portion 141*b* of the first lever 141 and an opposite second end 139*b* connected (for example rotatably) to the auxiliary support member 147. Going into further detail the second end 139*b* of the suspension device 139 is connected to the auxiliary support member 147 at an its lower region 147*d* that extends downwards from the front portion 147*a*, below the fifth and third coupling points 148, 145: practically the end 139*b* is engaged, for example rotatably engaged, to the auxiliary support member at a point spaced downwards from the third coupling point 145 so that the suspension device is arranged transversely to the first lever 141. It is to be noted that in both the first and second end stroke positions of the auxiliary support member 147, the lower region 147*d* extends below the fifth and third coupling points 148, 145 and the end 139*b* is engaged, for example rotatably engaged, to the auxiliary support member at a point spaced downwards from the third coupling point 145.

In turn, the intermediate portion 141*b* of the first lever 141 where the first end of the suspension device 139 is connected, extends above said fifth and third coupling points in both said first and second end stroke positions of the auxiliary support member 147.

In order to transfer in a substantially balanced way the load, the suspension device 139 includes a left suspension device 139' active on a left side of the apparatus 1 and a right suspension device 139" active on a right side of the apparatus; consequently, the mechanism 140 includes a left mechanism on a left side of the apparatus and a right mechanism on a right side of the apparatus; the left suspension device 139' is interposed between a left side of the cleaning unit 50 and the left mechanism linking a forward left end of the chassis 138 to the cleaning unit 50 support framework 63, whereas the right suspension device 139" is interposed between a right side of the cleaning unit 50 and the right mechanism linking a forward right end of the chassis 138 to the cleaning unit 50 support framework 63; optionally the left suspension device 139' is cinematically identical (i.e. it has the same arrangement, geometry and type of connection to the other components of the apparatus) to the right suspension device 139". Also the left mechanism may be identical to the right mechanism.

According to another aspect the suspension device 139 (or each of the left and right suspension devices 139' and 139") includes an elastic suspension device, for example a spring suspension or a pneumatic suspension. In the attached figures, each suspension device is a pneumatic cylinder.

According to another aspect combinable with or independent from the other aspects herein described, the cleaning unit 50 includes a left cleaning disc 51 and a right cleaning disc 52 (see the example of FIG. 12-15); each of the left and right cleaning discs 51, 52 has a respective lower side 51*a*, 52*a* configured to clean the floor and a respective upper side 51*b*, 52*b* opposite to the lower side; a motor assembly 53 is configured to operate in rotation the left cleaning disc and the right cleaning disc 51, 52 around a respective axis of rotation 51*x*, 52*x*; the cleaning unit 50 includes finally at least a presser device 54 active on a peripheral portion of the upper side 51*b* of the left cleaning disc 51 and on a peripheral portion of the upper side 52*b* of the right cleaning disc 52. Practically the presser device exerts a localized action on the peripheral portion of the upper side of each disc: optionally the presser device 54 is active on a left area, for example at extreme left, of the peripheral portion of the upper side 52*b* of the right disc 52, whereas the presser device is simultaneously active on a right area, in particular at extreme right, of the peripheral portion of the upper side 51*b* of the left disc 51.

As it may be seen from the mentioned figures, the presser device 54 includes actually a left presser 55 active on the peripheral portion of the upper side 51*b* of the left cleaning disc 51 (at said area at the extreme right of the peripheral portion) and a right presser 56 active on a peripheral portion of the upper side 52*b* of the right cleaning disc 52 (at said area at the extreme left of the peripheral portion). The left presser 55 is active exclusively on the peripheral portion (which is in the form of a peripheral band) of the upper side 51*b* of the left cleaning disc 51 which during the use slides underneath the left presser so that only the aforementioned right area of the peripheral portion or band receives the action of the left presser 55. Similarly the right presser 56 is active exclusively on the peripheral portion (which is also in the form of a peripheral band) of the upper side 52*b* of the right cleaning disc 52 which during the use slides underneath the right presser so that only the aforementioned left area of the peripheral portion or band receives the action of the right presser 55.

As shown in the attached figures, the peripheral band of the upper side 51*b* of the left cleaning disc 51 is preferably planar and has the form of an annulus concentric to the axis of rotation 51*x* of the left cleaning disc 51, and, similarly the peripheral band of the upper side 52*b* of the right cleaning disc 52 is preferably planar and has the form of an annulus concentric to the axis of rotation 52*x* of the right cleaning disc 52.

The presser device 54 is elastically pushed, in detail constantly pushed, towards the upper side of each one of the left and right cleaning discs 51, 52: more precisely, the left presser 55 is constantly elastically pushed towards the peripheral portion of the upper side 51*b* of the left cleaning disc 51 and the right presser 56 is constantly elastically pushed towards the peripheral portion of the upper side 52*b* of the right cleaning disc 52. Thanks to the characteristics described, the area of the peripheral band of the upper side 51*b* of the left cleaning disc and the area of the peripheral band of the upper side 52*b* of the right cleaning disc, areas which are in fact directly adjacent to each other are constantly pushed downwards so that the cleaning discs act efficiently at the band of floor on the perimeter edges of the two cleaning discs.

According to a further aspect and going into structural detail of the pressers, each one of said left presser 55 and right presser 56 includes: a contact element 57 active on the peripheral portion, in particular on the peripheral band, of the upper side 51*b*, 52*b* respectively of the left cleaning disc 51 and of the right cleaning disc 52. Each presser includes also a respective support structure 58 that supports the contact element 57 and that has a holding body 59, and at least a lever 60 interposed between the holding body 59 and the contact element 57; the lever 60 has a superior portion 60*a* hinged to the holding body 59 and an inferior portion 60*b* carrying the contact element 57. Finally, each presser includes a spring 61 interposed between the holding body 59 and the lever 60 and configured to push the lever towards the upper side 51*b*, 52*b* of the respective left or right cleaning disc 51, 52.

In the example of FIG. 12-15, the spring 61 is a torsional spring having one end 61*a* acting on the lever 60 and one opposite end 61*b* acting on the holding body 59. As an alternative to the described torsional spring, an elastic organ may be used: for example a laminated spring or a compression spring or others.

Still referring to the example illustrated in FIG. 12-15, the support structure 58 includes two parallel levers 60 having the superior portions 60*a* hinged to the holding body and the inferior portions 60*b* forming a fork that carries at the end the contact element 57.

As already mentioned, the contact element 57 of the left presser 55 acts on the upper side of the peripheral portion of the left cleaning disc 51 and the same peripheral portion of the left cleaning disc 51 is able to rotate under and in contact with the contact element 57 of the left presser 55, whereas the right presser 56 acts on the upper side of the peripheral portion of the right cleaning disc 52, with the peripheral portion of the right cleaning disc which is able to rotate under and in contact with the contact element 57 of the right presser 56. In order to allow a smooth rotation with low friction of the cleaning discs, the contact element 57 includes a rotating element, for example at least a wheel for each one of the right and left pressers, rotatably engaged to the inferior portion 60*b* of the lever 60: in the shown example each contact element 57 optionally includes a wheel rotatably engaged to the inferior portion of two parallel levers 60 through an axle 62 pivotally engaged to the fork formed by the two levers. Each rotating element, in particular each wheel is mounted by rotation around a horizontal axis 57*x* parallel to the plane of the peripheral band and is elastically pushed downwards so as to exert a localized pressure on a very limited area of the peripheral band of the upper side of each disc (including a section of the peripheral band of limited angular extension placed on the side of the peripheral band facing towards the longitudinal centerline or centerline L of the apparatus 1).

According to a further aspect, the axes of rotation 51*x*, 52*x* of the left and right cleaning discs 51, 52 are vertical and the discs have a lower surface designed to contact the floor for example horizontal flat, slightly curved or slightly wavy.

The holding body 59 of the left presser 55 and the holding body 59 of the right presser 56 may be rigidly connected, for example formed in a single piece, and are mounted to the support framework 63 of the cleaning unit 50.

According to another aspect, the left and right cleaning discs 51, 52 are offset with respect to a direction of travel D, which may coincide with the direction defined by the longitudinal or centerline L, of the apparatus 1; in particular, the left and right cleaning discs 51, 52 are mounted in the cleaning unit 50 such that a centerline C running through the centers 51*c*, 52*c* of the left and right cleaning discs is neither perpendicular to a longitudinal center line L of the apparatus nor to the direction of travel D (but vice versa forms an acute angle $\alpha$ indicated in FIG. 14) with said line L and direction D. In this configuration and as it may be noted from FIG. 14, the contact element 57 of the left presser 55 and the contact element 57 of the right presser 56 are offset with respect to the direction of travel D of the apparatus 1. Consequently, the area where the right pressor 56 acts under pressure is a section of the perimeter portion slightly rearward (or advanced if the discs are offset in an opposite way with respect to what is shown in figures) with respect to the portion of the centerline C which intersects the peripheral band of the upper side 52*b* of the right cleaning disc 52, whereas the area where the left presser 55 acts under pressure is a section of the perimeter portion slightly advanced (or rearward if the discs are offset in an opposite way with respect to what is shown in figures) with respect to the portion of the centerline C which intersects the peripheral band of the upper side 51*b* of the left cleaning disc 51.

Finally, as it may be seen in FIG. 12-15, the axis of rotation 57*x* of the contact element 57 (rolling element or wheel) of the left presser 55 and the axis of rotation 57*x* of the contact element 57 of the right presser 56 are parallel and offset and in particular perpendicularly directed to the direction of travel D and to the centerline L of the apparatus.

According to an additional aspect the motor assembly 53 is configured to turn the left and right discs 51, 52 according to opposite directions of rotation: in this way the rotating action on the discs combined with the action of the pressors described promotes the generation of a direct traction force along the direction of travel D.

According to a further aspect combinable with or independent from the other aspects here described, the cleaning unit 50 of the assembly 500 is of the type having one or more (in particular for example two) cleaner rollers. Each cleaner roller 110 is engaged to the support framework thanks to a first and a second connector 111, 112 interposed between the support framework 63 and opposite ends of each cleaner roller 110 in order to rotatably engage the cleaner roller 110 itself to the support framework 63 about a substantially horizontal axis of rotation X. In more detail, at least one between the first and the second connector 111, 112 includes a male component 113 and a female component 114 coupled together in a removable manner. In the examples shown in FIG. 17-23 one or both ends of each cleaner roller include the female component 114, whereas the male component or components 113 are carried by the support framework 63.

According to an aspect, the male component 113 has at least one base 115 having at least a plurality of radial projections 116 configured for engaging the female component 114 and preventing a relative rotation between the male component 113 and the female component. The male component 113 has also one invitation portion 117 extended as a prolongation of the base 115 along the axis of rotation X; the invitation portion 117 has a tapered shape moving away from the base 115 and is configured for guiding the male component 113 in at least partial insertion (or almost entire as it may be seen in FIG. 23) within the female component 114. The base 115 has a central body with cylindrical lateral wall 119 coaxial with said axis of rotation X and the radial projections 116 emerge from the lateral wall 119 moving away from axis X. The radial projections emerging from the lateral wall 119 are for example angularly offset from each other by an angle comprised between 30° and 90°.

According to a further aspect, each radial projection 116 extends along a direction parallel to the axis of rotation X and includes a main portion 116*a* and an end portion 116*b*, following the main portion 116*a* and facing the invitation portion 117: the end portion 116*b* has a tapered shape configured for guiding each radial projection in engagement within a respective indentation 120 (for example groove-shaped) of the female component 114. Each radial projection has, at the external surface of the lateral wall 119 of the central body, an angular extension comprised between 0° and 20°, in particular between 2° and 20°. Furthermore, each of the radial projections 116 is laterally delimited by sides 121*a* parallel to each other or slightly converging moving away from the axis of rotation: the end portion 116*b* of each of the radial projections 116 is laterally delimited by sides 121*b* converging with respect to each other approaching the invitation portion. Consequently, the angular extension of the end portion 116*b* of each radial projection 116 decreases approaching the invitation portion 117. For example the converging sides 121*b* of the end portion 116*b* of each radial projection may be incident with respect to each other at the invitation portion 117 to define a sharp or smoothed edge, and may form an angle comprised between 10° and 90°.

According to a further aspect each projection 116 is superiorly delimited by a top wall 122 having a curvilinear shape, with a concavity directed towards the axis of rotation X. The top walls 122 of the radial projections 116 lie in particular on a same ideal cylindrical surface.

The male component 113 has one recess 123 in interposition between each pair of angularly successive radial projections 116: the recess 123 is configured for receiving, in engagement, a radial counter-projection 124 of the female component 114. Each recess 123 of the male component 113 is inferiorly delimited by the lateral wall 119 of the central body 118 and is at least partly counter-shaped to the radial counter-projection 124 of the female component 114.

According to another aspect, the invitation portion 117 has a predetermined longitudinal extension along the axis of rotation X comprised between 70% and 99% of the longitudinal extension of the main body of the base 115 along the same direction. Furthermore, the invitation portion 117 has an external surface converging moving away from the base 115; optionally the invitation portion 117 has a conical or frustoconical shape.

In another aspect, the male component 113 has an attachment flange 125 emerging from the base 115 on the side opposite the invitation portion 117: the attachment flange 125 may radially project with respect to each of the radial projections 116 and is a torsionally couplable to at least one between a drive shaft (direct drive) or a motorized component 126 which allows an indirect connection with the motor shaft. In turn, the base 115 has at least a cavity 127 extending starting from one end of the base 115 opposite to the invitation portion 117 in the direction of the latter: the cavity 127 defines a passage suitable to allow the insertion of a portion of the drive shaft or of the motorized component 126. The base 115 shows also one through hole 128 directed transversally to the axis X and facing the cavity 127 to allow the insertion of at least one constraint element configured for blocking (at least torsionally) the male component 113 with respect to the portion of the drive shaft or of the motorized component 126. As it may be seen from FIGS. 21 and 22, the through hole is defined at one of the recesses 123, in interposition between two angularly successive radial projections 116. In the shown example, the male component 113 has a first and a second through hole 138 aligned with each other along a same radial direction incident on the axis of rotation X (and radially opposite): the first and the second through hole face both the cavity 127 so that to define a respective passage suitable to allow the insertion of at least constraint element configured for blocking at least torsionally the male component 113 with respect to the drive shaft or to the motorized component 126.

According to a further aspect, the female component 114 includes a main body 129 defining an internal volume for at least partly housing the male component 113. In more detail, the main body 129 has a radial shoulder 130 at a passage opening 131 to the internal volume which is designed to act in abutment against a terminal edge of the cleaner roller 110. As already mentioned, the female component 114 engages the cleaner roller 110 at one end of the latter, with an external wall 132, optionally cylindrical, of the main body 129 which inserts in a corresponding cavity of the cleaner roller 110. Each radial counter-projection 124 radially emerges from the main body 129 towards the internal volume and is configured to be arranged in insertion within a respective recess 123 of the male component 113. As it may be seen from the mentioned figures, a plurality of radial counter-projections emerging from the main body 129 of the female component 114 and angularly offset from each other by an angle comprised between 30° and 90° are provided. Each radial counter-projection 124 extends along a direction parallel to the axis of rotation X and has a main portion 124*a*, as well as an end portion 124*b* following the main portion 124*a* and facing at the passage opening; the end portion 124*b* has in turn a tapered shape configured for guiding the radial counter-projection 124 in engagement within the respective recess 123 of the male component 113, ensuring an easy insertion and an effective, torsional coupling between the two parts once the insertion is complete.

According to other auxiliary aspects, each radial counter-projection has, at the internal surface of the external wall 132 of the main body 129, an angular extension comprised between 0° and 20° and in particular comprised between 2° and 20°. Furthermore, the main portion 124*a* of each of the radial counter-projections is laterally delimited by sides 133*a* converging among them radially moving toward the axis of rotation X; the end portion 116*b* of each of said radial counter-projections 124 is preferably laterally delimited by sides 133*b* converging among them both radially moving toward the axis of rotation X, and moving approaching the passage opening. The angular extension of the end portion 124*b* of each radial counter-projection 124 of the female component 114 is, for example, decreasing approaching the passage opening 131. Furthermore, in the example in the figures, the converging sides 133*b* of the end portion 116*b* of each counter-projection 124 are incident with respect to each other at the passage opening 131 to define a sharp or smoothed edge, and subtend an angle comprised between 10° and 90°.

According to other aspects, each radial counter-projection 124 is superiorly bounded by a top wall 134 having a curvilinear shape, with a concavity directed towards the internal volume of the main body 129. In detail, the top walls 134 of the radial counter-projections 124 lie for example on a same ideal cylindrical surface. It is to be noted that the indentation 120 of the female component 114 extends in interposition between two angularly successive radial counter-projections 124 and is configured for receiving in engagement, a respective radial projection 116 of the male component 113.

The sides 133*a* of the main portion 124*a* of each counter-projection 124 may diverge from each other moving away from the passage opening 131, conferring to each indentation 120 an angular extension that is progressively reduced, always proceeding moving away from the passage opening; in particular, the angular width of each indentation 120, measured on the internal surface of the external wall 132, reduces from 1° to 3° following the entire extension of the main portion 124*a* of the radial counter-projections adjacent to the same indentation 120. As it may be seen from the figures, the indentation 120 of the female component 114 is inferiorly delimited by the internal surface of the external wall 132: said indentations 120 of the female component 114 may in particular be at least partly (or entirely) counter-shaped with respect to a respective radial projection 116 of the male component 113.

In another aspect the apparatus 1 and in detail the casing 135 has at least one hatch 136 removably engaged to the casing itself to allow a user to reach the compartment where the cleaner roller/s are housed. Alternatively to the hatch, it may be provided a flap hinged to the casing 135 or slid with respect to the latter and configured, when in open position, to allow a user to reach the compartment. In a variant the male component 113 or female component 114 of the second connector 112 is engaged with the hatch 136 or with the flap and is movable by rotation with respect to the latter: the male component 113 or female component 114 of the second connector 112 is removably engageable with a corresponding element, respectively female or male, carried by the cleaner roller 110 at one end of the latter opposite with respect to the one where the first connector 111 operates, as already explained.

It should be noted that in the examples illustrated in the accompanying figures, in a non-limiting manner, two cleaner rollers 110 engageable with respective first and second connectors 111, 112 are provided: each of said cleaner rollers is movable by rotation around the respective horizontal axis of rotation parallel to that of the adjacent roller.

Finally, the cleaning unit 50 includes at least a motor 137 (for example an electric motor) carried by the support framework 63 directly engageable with the male component 113, or indirectly engageable with the same male component 113 through the motorized component 126.

Aspects of the present disclosure have been described with reference to the currently preferred embodiments; however, the present disclosure is not limited to the embodiments above described, but on the contrary, the present disclosure covers modifications and variants, as well as equivalent solutions, comprised within the scope of the attached claims.

The invention claimed is:

1. A floor cleaning apparatus (1) comprising:

a cleaning assembly (500);

a suction unit (10) provided with a motor (11) and an impeller (12) coupled with the motor (11);

an inlet channeling unit (20), operative at an inlet side of the suction unit (10), wherein the inlet channeling unit (20) is in fluid communication with at least one portion of the cleaning assembly (500);

an outlet channeling unit (30), connecting an outlet side of the suction unit (10) to at least one exhaust aperture (40) of the floor cleaning apparatus (1);

wherein the outlet channeling unit (30) comprises:

a first expansion chamber (31) facing the outlet side of the impeller (12) and having an outlet port (31*a*) in fluid communication with the exhaust aperture (40), wherein the first expansion chamber (31) extends about a periphery of the impeller (12) defining an annular flow volume entirely surrounding the impeller (12), wherein the annular flow volume of the first expansion chamber (31) has a transversal air flow cross sectional area, measured perpendicular to the axis of rotation (12*a*) of the impeller (12), having a prefixed maximum area and having an annulus shape, at least one intercepting wall (100) comprising a plurality of through holes (101), the intercepting wall (100) operating inside the first expansion chamber (31) and being positioned to intercept air flow moving from the impeller outlet side to the outlet port (31*a*) of the first expansion chamber (31), wherein the intercepting wall (100) has an annular shape and is inserted in the annular flow volume of the first expansion chamber (31), wherein a first compression channel (33) connects the first expansion chamber (31) to a second expansion chamber (32) and wherein the first compression channel (33) has a transversal air flow cross sectional area, measured perpendicular to the axis of rotation (12*a*) of the impeller (12), having a prefixed minimum area which is smaller than said maximum transversal air flow cross sectional area of the annular flow volume of the first expansion chamber (31).

2. The floor cleaning apparatus (1) according to claim 1, wherein the first expansion chamber (31) radially extends between the outlet side of the impeller (12) and an outer peripheral wall (31*c*) surrounding the impeller (12) and is positioned at a radial distance from the outlet side of the impeller (12), wherein the at least one intercepting wall (100) is positioned radially between the outlet side of the impeller (12) and the outer peripheral wall (31*c*) of the first expansion chamber (31);

wherein the first expansion chamber (31) and/or the intercepting wall (100) are concentrically positioned relative to the impeller (12) and extend all around the impeller periphery;

and wherein the annular flow volume of the first expansion chamber (31) has a constant radial width.

3. The floor cleaning apparatus (1) according to claim 1, wherein the through holes (101) on the intercepting wall (100) have axial symmetry, optionally cylindrical conformation;

wherein each one of the plurality of through holes (101) has an area of fluid passage, measured perpendicular to the respective axis of symmetry (101*a*), of between 3 mm2 and 180 mm2;

wherein the through holes (101) have respective axes of symmetry (101*a*) parallel to each other or converging towards a common axis, optionally converging towards an impeller axis of symmetry (12*a*).

4. The floor cleaning apparatus (1) according to claim 1, wherein each one of the through holes (101) has a cross section, taken perpendicular to the respective axes of symmetry (101*a*), which is circular and which has a diameter of between 2 mm and 15 mm.

5. The floor cleaning apparatus (1) according to claim 1, wherein the through holes are distributed, optionally homogeneously distributed, on the intercepting wall and positioned all around the impeller periphery; optionally wherein one or more series of through holes are present on the intercepting wall, with each series of through holes comprising through holes at a same angular distance from one another and positioned all around the impeller periphery.

6. The floor cleaning apparatus (1) according to claim 1, wherein the first compression channel (33) is directed upwards, optionally extends at least in part parallel to axis of rotation (12*a*) of the impeller (12), and wherein the second expansion chamber (32) is positioned above, substantially in overlapping, the first expansion chamber (31); and wherein the second expansion chamber (32) extends around the motor (11).

7. The floor cleaning apparatus (1) according to claim 1, wherein the outlet channeling unit (30) comprises:

a third expansion chamber (34) positioned downstream the second expansion chamber (32), and a second compression channel (35) placing in fluid communication the second expansion chamber (32) with the third expansion chamber (34);

a transition channel (38) extending between the third expansion chamber (34) and a fourth expansion chamber (39) terminating into the exhaust aperture (40) of the floor cleaning apparatus (1), wherein the transition channel (38) defines a compression of air and has an air flow path with zig-zag conformation for air flowing from the third expansion chamber (34) to the fourth expansion chamber (39), wherein the air flow path changes direction at least twice before reaching the exhaust aperture (40).

8. The floor cleaning apparatus (1) according to claim 1, wherein no alveolar material is applied to walls delimiting the first expansion chamber; optionally wherein the entire outlet channeling unit (30) comprises no alveolar material applied contacting an air flow crossing the outlet channeling unit and/or the entire inlet channeling unit (20) comprises no alveolar material contacting an air flow crossing the inlet channeling unit.

9. A floor cleaning apparatus (1) comprising:

a cleaning assembly (500);

a suction unit (10) provided with a motor (11) and an impeller (12) coupled with the motor (11);

an inlet channeling unit (20), operative at an inlet side of the suction unit (10), wherein the inlet channeling unit (20) is in fluid communication with at least one portion of the cleaning assembly (500);

an outlet channeling unit (30), connecting an outlet side of the suction unit (10) to at least one exhaust aperture (40) of the floor cleaning apparatus (1);

wherein the outlet channeling unit (30) comprises:

a first expansion chamber (31) facing the outlet side of the impeller (12) and having an outlet port (31*a*) in fluid communication with the exhaust aperture (40), at least one intercepting wall (100) comprising a plurality of through holes (101), the intercepting wall (100) operating inside the first expansion chamber (31) and being positioned to intercept air flow moving from the impeller outlet side to the outlet port (31*a*) of the first expansion chamber (31), at least one spent liquid receptacle (75) and at least one suction pipe (41), wherein the inlet channeling unit (20) is in fluid communication with said at least one portion of the cleaning assembly (500) via the suction pipe (41);

and wherein the inlet channeling unit (20) is positioned above the spent liquid receptacle (75) and is in fluid communication with the suction pipe (41) and the suction pipe (41) connects said at least one portion of the cleaning assembly (500) with the at least one spent liquid receptacle (75).

* * * * *